US012767299B2

(12) United States Patent
Dombois

(10) Patent No.: US 12,767,299 B2
(45) Date of Patent: Oct. 20, 2026

(54) KITE RIGGING CONTROL APPARATUS

(71) Applicant: Markus Dombois, Stockton, CA (US)

(72) Inventor: Markus Dombois, Stockton, CA (US)

( * ) Notice: Subject to any disclaimer, the term of this patent is extended or adjusted under 35 U.S.C. 154(b) by 473 days.

(21) Appl. No.: 18/238,477

(22) Filed: Aug. 26, 2023

(65) Prior Publication Data

US 2025/0066003 A1 Feb. 27, 2025

(51) Int. Cl.
*B63H 8/16* (2020.01)

(52) U.S. Cl.
CPC ..... *B63H 8/16* (2020.02)

(58) Field of Classification Search
CPC ..... B63H 8/16
See application file for complete search history.

(56) References Cited

U.S. PATENT DOCUMENTS

| | | | | |
|---|---|---|---|---|
| 6,273,369 | B1 * | 8/2001 | Nishimura | B63H 8/16 244/155 A |
| 7,036,771 | B1 * | 5/2006 | Pouchkarev | B63H 8/18 244/152 |
| 7,686,254 | B2 * | 3/2010 | Mutzenberg | B63H 8/16 244/155 A |
| 2004/0065780 | A1 * | 4/2004 | Bellacera | B63H 8/18 244/155 A |
| 2004/0182968 | A1 * | 9/2004 | Gentry | B63H 8/18 244/155 A |
| 2006/0226294 | A1 * | 10/2006 | Logosz | B63H 8/18 244/152 |
| 2008/0035796 | A1 * | 2/2008 | See | B63H 8/58 244/155 A |
| 2008/0067291 | A1 * | 3/2008 | Logosz | B63H 8/12 244/155 A |
| 2008/0223989 | A1 * | 9/2008 | Mutzenberg | B63H 8/16 244/155 A |
| 2012/0018584 | A1 * | 1/2012 | Lawson | B63H 8/16 244/155 A |
| 2012/0049006 | A1 * | 3/2012 | Logosz | B63H 8/18 244/155 A |
| 2018/0022430 | A1 * | 1/2018 | Camblong | B63H 8/16 114/102.11 |

FOREIGN PATENT DOCUMENTS

| | | | | |
|---|---|---|---|---|
| DE | 10340360 | A1 * | 4/2005 | B63H 8/18 |
| DE | 102005036836 | A1 * | 2/2007 | B63H 8/16 |
| DE | 202009002826 | U1 * | 5/2009 | B63H 8/10 |
| DE | 112012006129 | T5 * | 12/2014 | B63H 8/16 |
| FR | 2818954 | A1 * | 7/2002 | B63H 8/18 |
| WO | WO-2004067381 | A2 * | 8/2004 | B63H 8/16 |

* cited by examiner

*Primary Examiner* — Marc Q Jimenez
*Assistant Examiner* — Jovon E Hayes

(57) ABSTRACT

A kite rigging control apparatus and method of use. A hand-actuated bailout trigger and optional depower handle is incorporated into the rigging of the traction kite. Should the kite begin to overpower the kiter, the kiter may immediately and easily depower the kite or readily activate the bailout trigger which immediately ceases the pull of the kite. The kiter may then safely recover the kite.

16 Claims, 25 Drawing Sheets

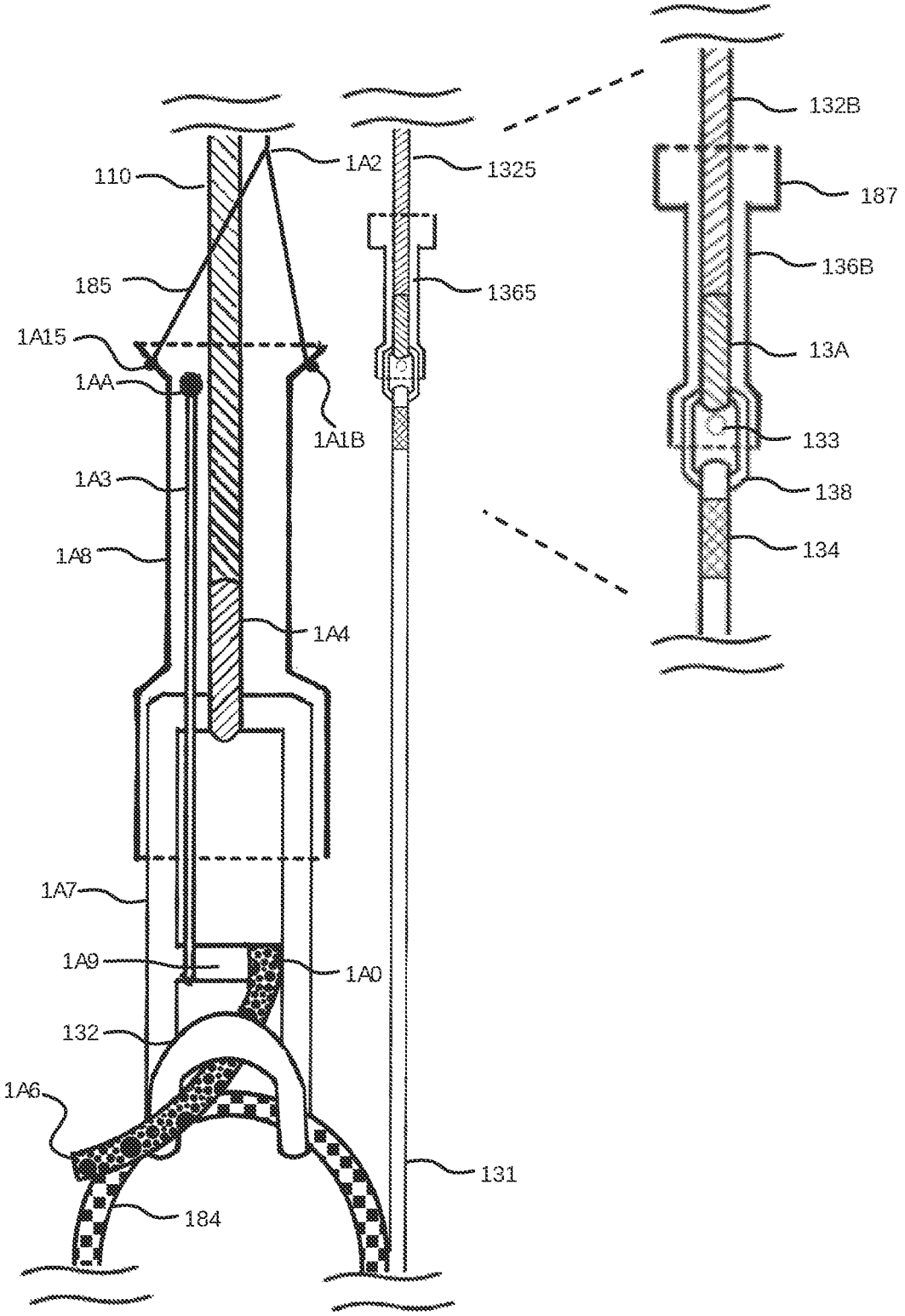
FIG. 2C1

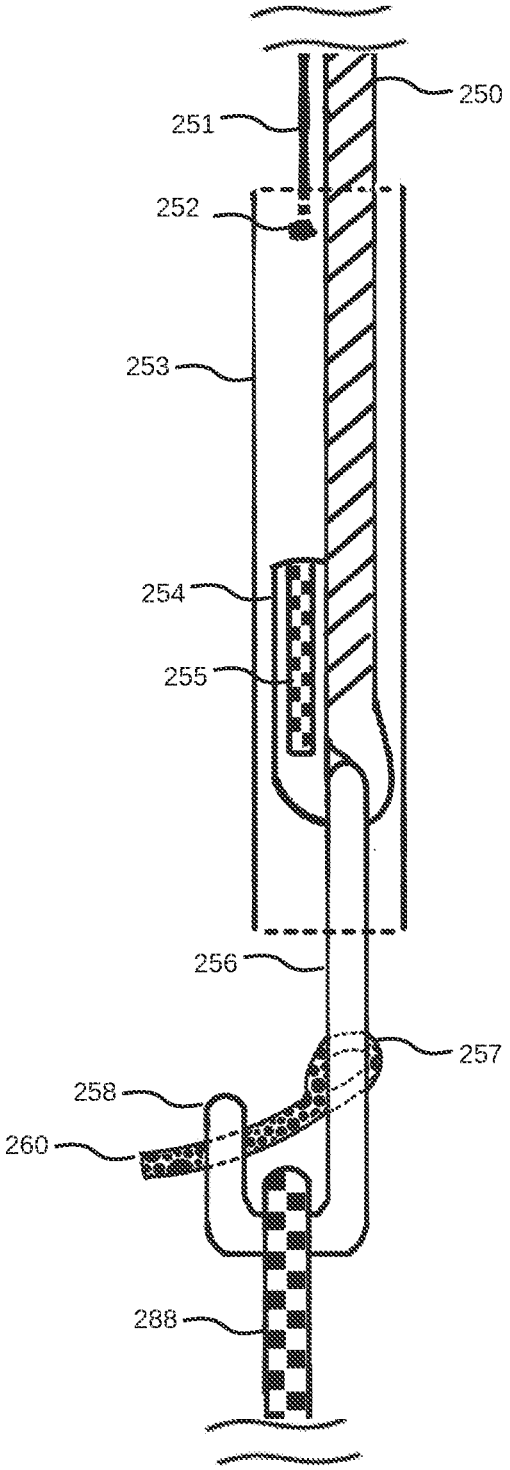
FIG. 2C2

Figure 2A:
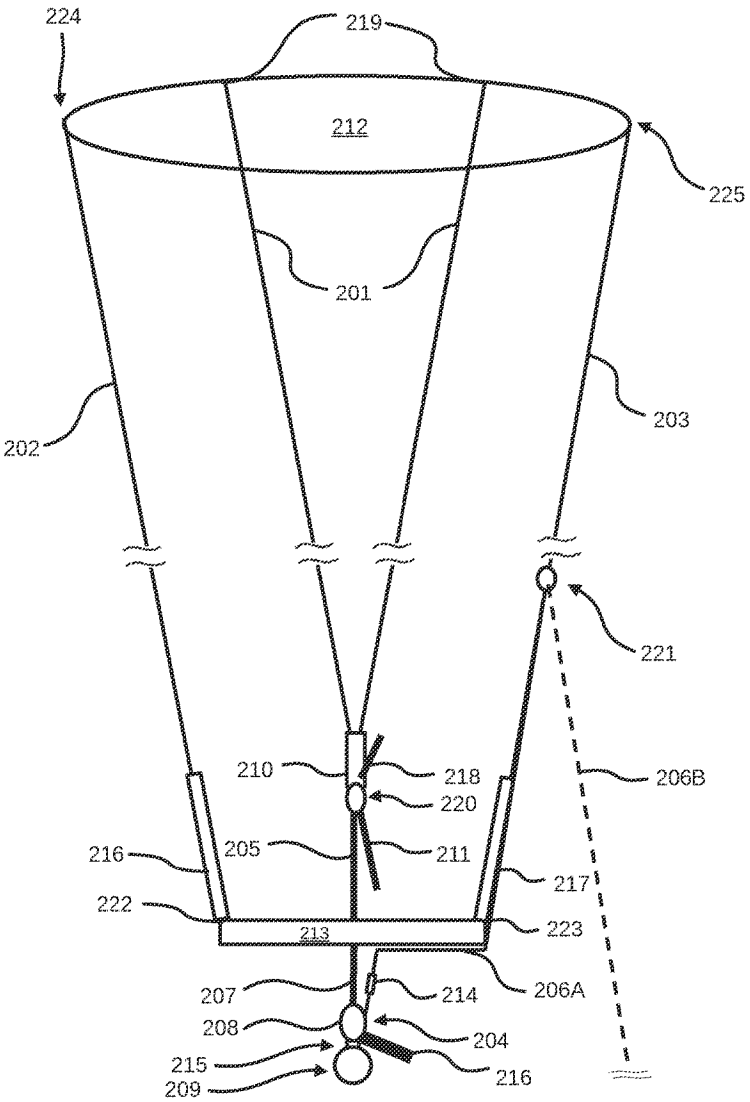
Figure 3A:
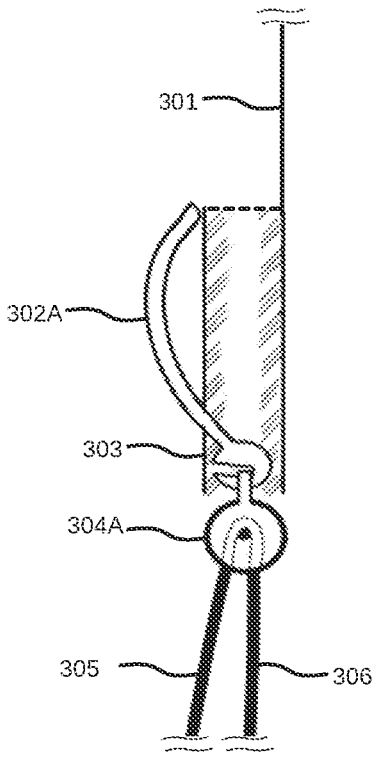
Figure 3B:
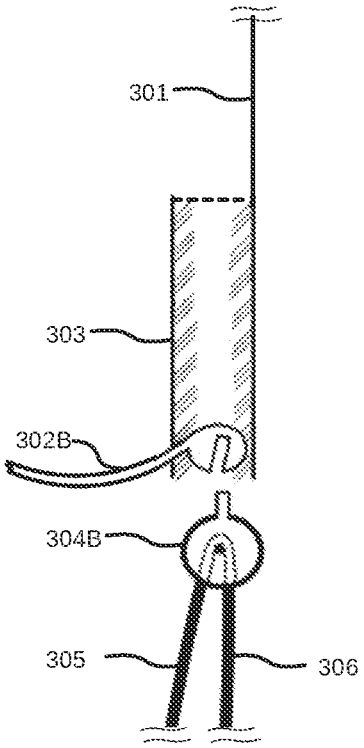

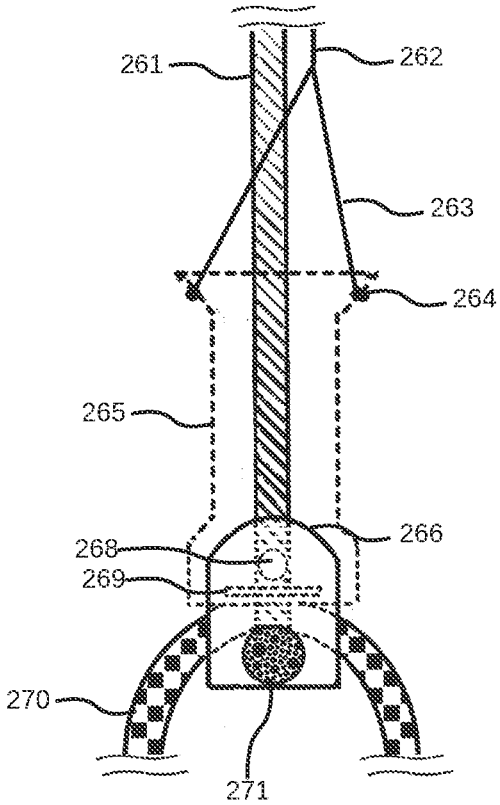
FIG. 2C3A
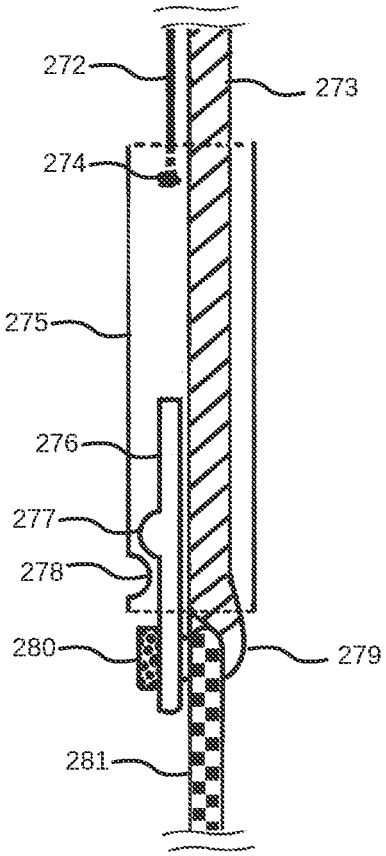
FIG. 2C3B

KITE RIGGING CONTROL APPARATUS

TECHNICAL FIELD

This disclosure generally relates to traction kite rigging control apparatuses.

BACKGROUND

Kiteboarding is and has been a dangerous and sometimes life-threatening sport since its inception over twenty years ago. Legacy techniques for safe traction kite flying requires the kite flyer (hereinafter "kiter") to divert their attention from the powerful traction kite overhead, to a quick release connection mounted to their harness. These legacy quick releases are invariably mounted below a kite control bar which the kiter is generally gripping with both hands in order to steer the kite. Should the kiter need to release themselves from the pull of the powerful kite, they always need to take at least one hand off of the kite control bar to manipulate the quick release at their waist.

Traction kites are designed to create enough force to pull a person or a vehicle, or both. The pulling force of a traction kite increases exponentially and immediately, with even the slightest movement of the kite. This happens as "apparent wind" accelerates over the canopy. Apparent wind is created by combining "true wind" (what the actual wind speed is over an unmoving or static object) together with the wind that flows over a moving object. Kites are unique from any other sail, in that a kite will create apparent wind, even when attached to a static object, should the kite start to move.

Serious and sometimes fatal accidents may occur in a fraction of a second if a kiteboarder (hereinafter "kiter") accidentally allows a large traction kite to dive and accelerate with gravity. Sometimes, before a kiter can prevent it, the kite may dive and then fly upwards in a loop, as the kiter struggles to maintain control. This action has deservedly been termed as a "death-loop." Every year since the inception of the sport, kiters have been killed because their kites have death-looped and then launched the unfortunately attached kiter into an immovable object. Sometimes, one kiter may lose control upwind and tangle with another kiter downwind, which really compounds the danger for both or any other kiter involved. Consequently, there is an urgent and long-felt need for addressing this and other issues associated with the dangers related to flying and controlling a traction kite.

SUMMARY

A kite rigging control apparatus and method of use. A hand-actuated bailout trigger and optional depower handle is incorporated into the rigging of the traction kite. Should the kite begin to overpower the kiter, the kiter may immediately and easily depower the kite or readily activate the bailout trigger which immediately ceases the pull of the kite. The kiter may then safely recover the kite.

BRIEF DESCRIPTIONS OF THE DRAWINGS

Figure 1A:
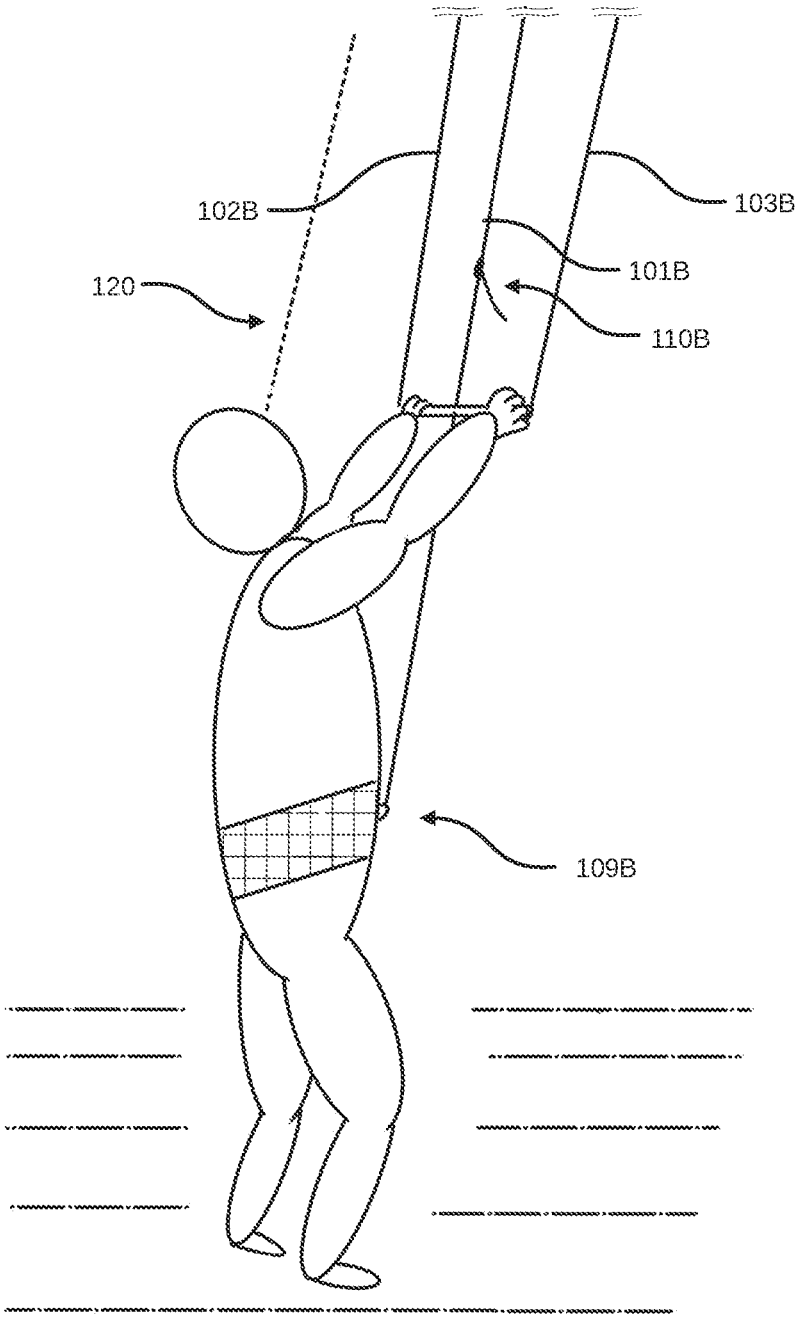

FIG. 1A presents an exemplar of a kiter using a legacy kite rigging control apparatus.

Figure 1B:
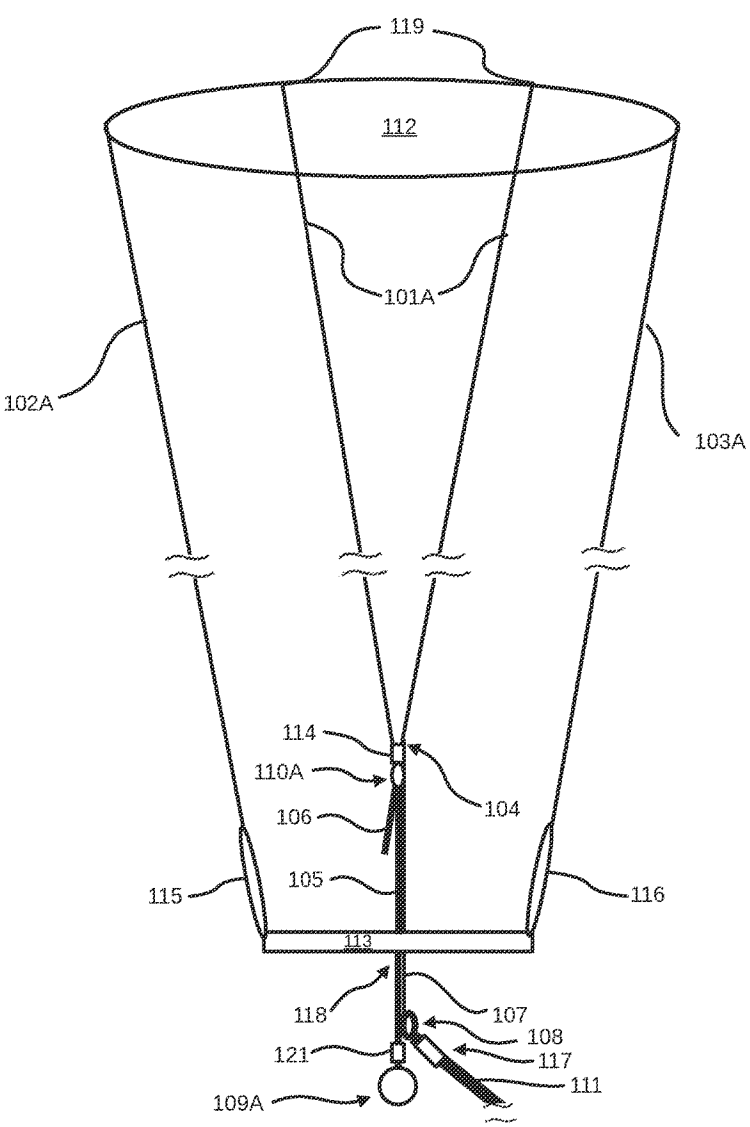

FIG. 1B presents an exemplar of a legacy kite rigging control apparatus on the same page as an illustration of FIG. 2A which presents an exemplar of the present kite rigging control apparatus for comparison purposes.

FIG. 2A presents an exemplar of the present kite rigging control apparatus.

Figure 2B:
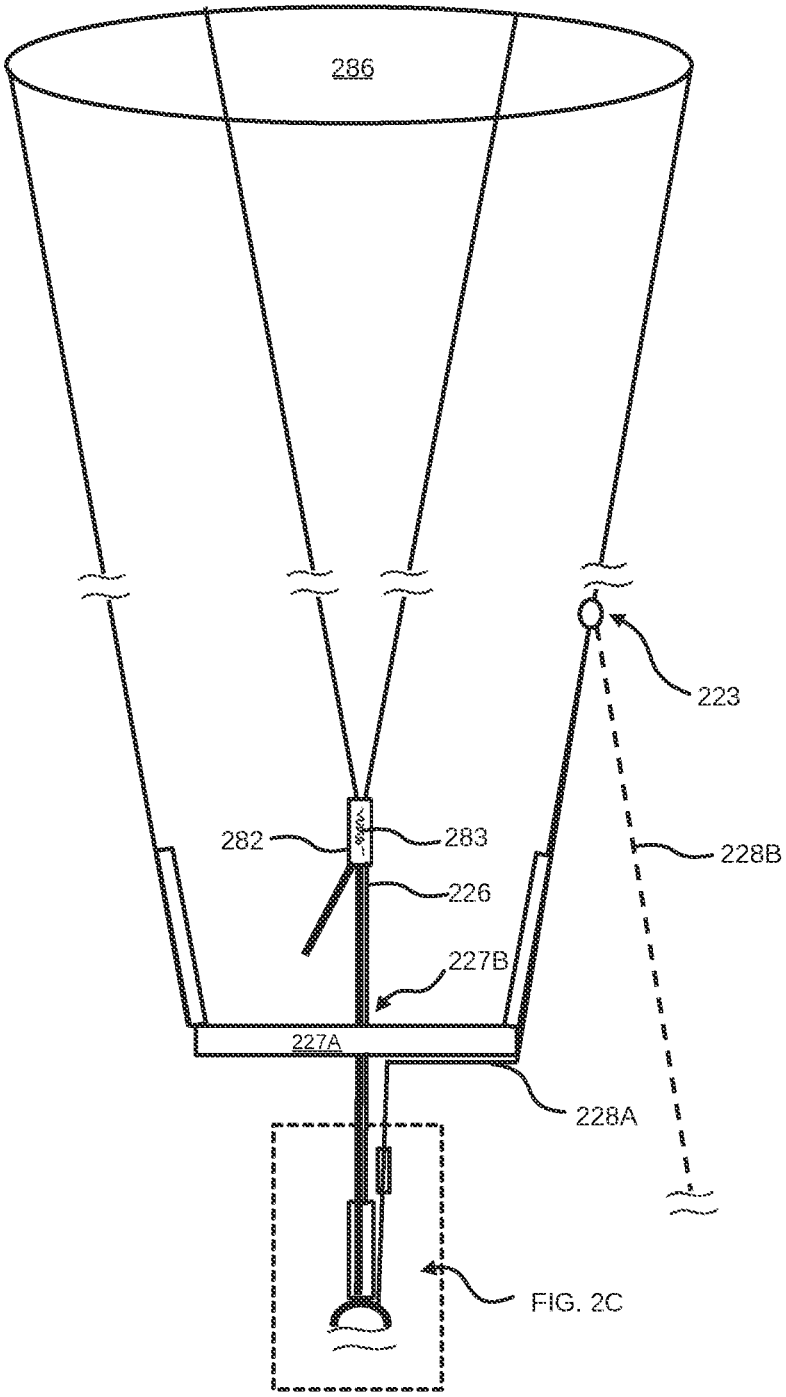

FIG. 2B presents an exemplar of the present kite rigging control apparatus with an exemplar bail out trigger which is also connected to a secondary quick-release shackle along with a recovery strap containing another quick-release.

FIG. 2C1 presents a close-up front view of FIG. 2B, an exemplar of an automatic quick-release shackle and hook assembly that may also be manually operated, together with a manual final release for a recovery strap. The hook is shown connected to an attachment point on the kiter's harness. Also shown is a detailed closeup view of the manual final release for the recovery strap.

FIG. 2C2 presents a right-side view of an exemplar of the same secondary quick-release shackle and hook assembly as in FIG. 2C1, while it is connected to an attachment point on the kiter's harness.

FIG. 2C3A presents a front view of an exemplar of an automatic quick release assembly that may also be manually operated.

FIG. 2C3B presents a right-side view of an exemplar of the quick release assembly depicted in FIG. 2C3A.

FIG. 3A presents a right-side view of an example hand-actuated bailout trigger and depower handle mechanism connected to a trim-cable assembly while in a locked position.

FIG. 3B presents a right-side view of a deployed hand-actuated bailout trigger and depower handle mechanism of FIG. 3A, after it has been activated, and the trim-cable assembly has been released.

Figure 3C:
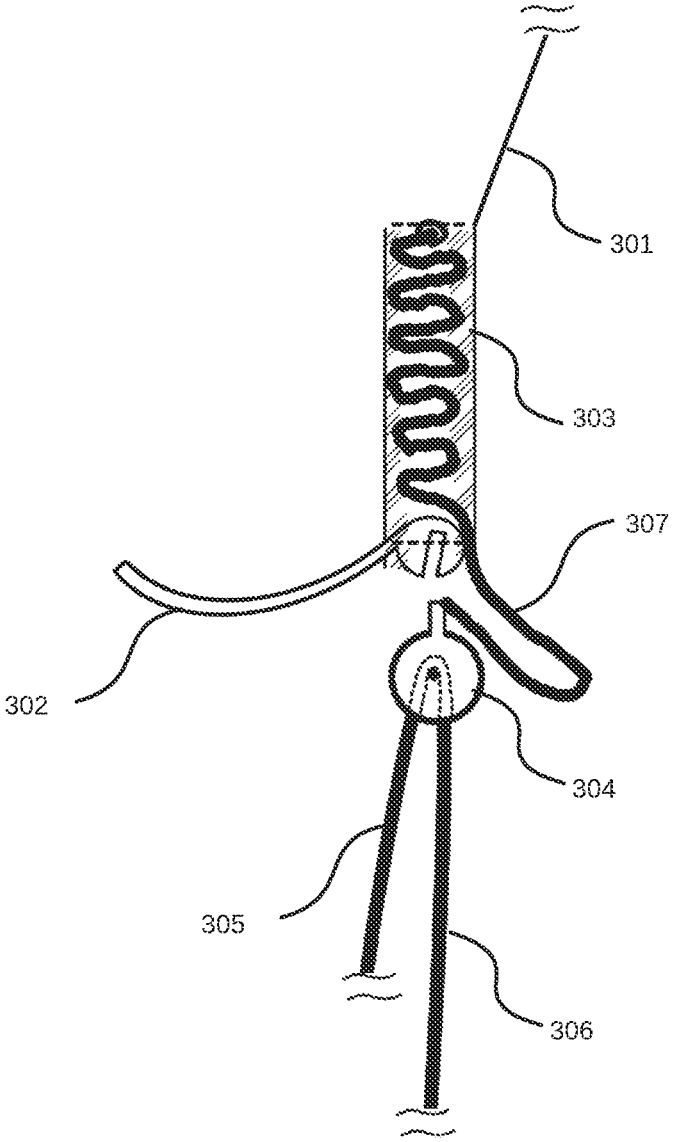

FIG. 3C presents a right-side view of an exemplar of a deployed hand-actuated bailout trigger and depower handle with an integral recovery line, wherein the trim-cable assembly has been released.

Figure 4A:
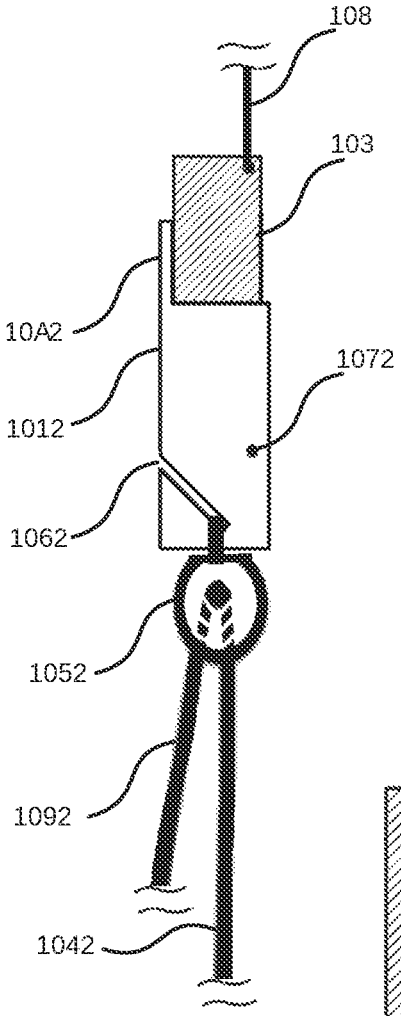

FIG. 4A presents a right-side view of an example hand-actuated bailout trigger and depower handle mechanism while it is attached to a trim-cable assembly.

Figure 4C:
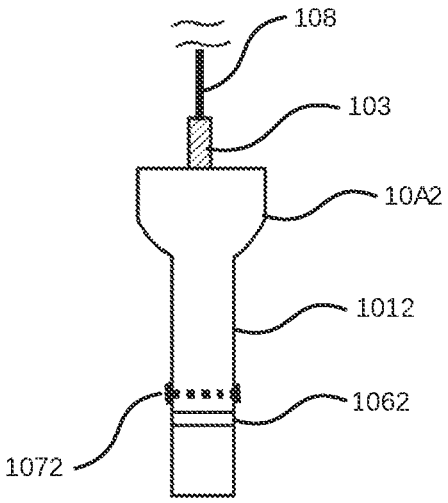
Figure 4B:
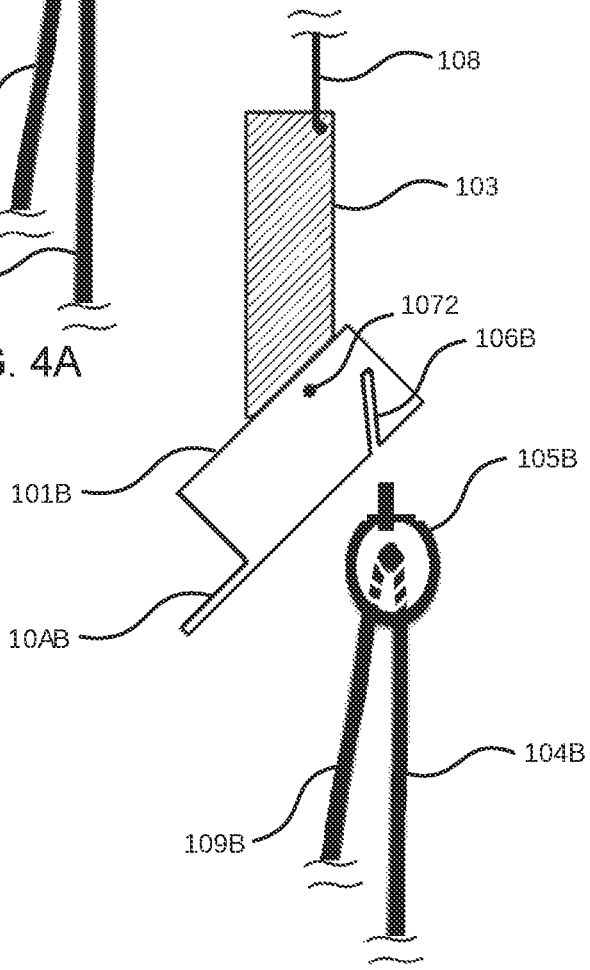

FIG. 4B presents a right-side view of the example hand-actuated bailout trigger and depower handle mechanism shown in FIG. 4A, after the trigger has been deployed and the trim-cable assembly has been released.

FIG. 4C presents a front view of the example hand-actuated bailout trigger and depower handle mechanism shown in FIG. 4A and FIG. 4B while in the locked position where the trim-cable assembly is not depicted.

Figure 4D:
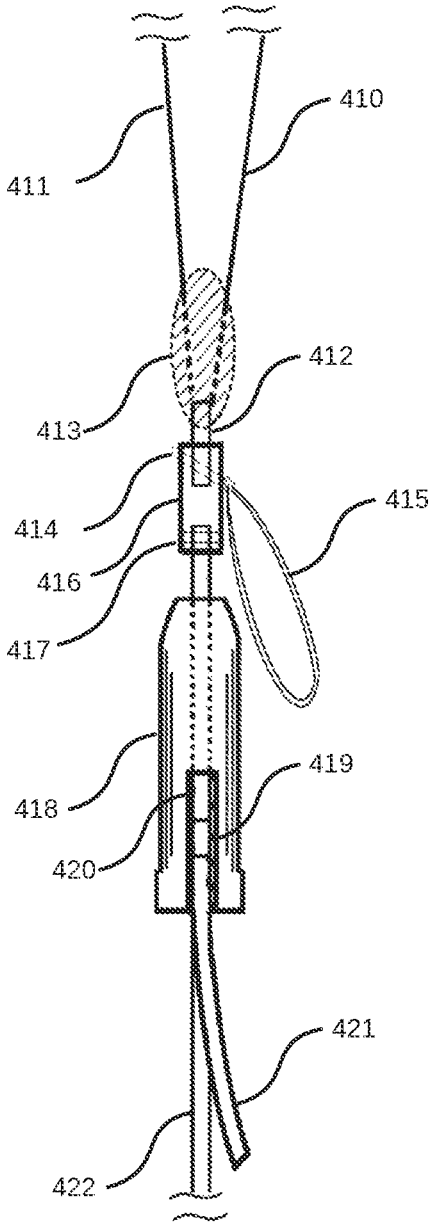

FIG. 4D presents an exemplar of a manual bailout trigger that is separate from a depicted exemplar of a depower handle containing an integral jam cleat.

Figure 5A:
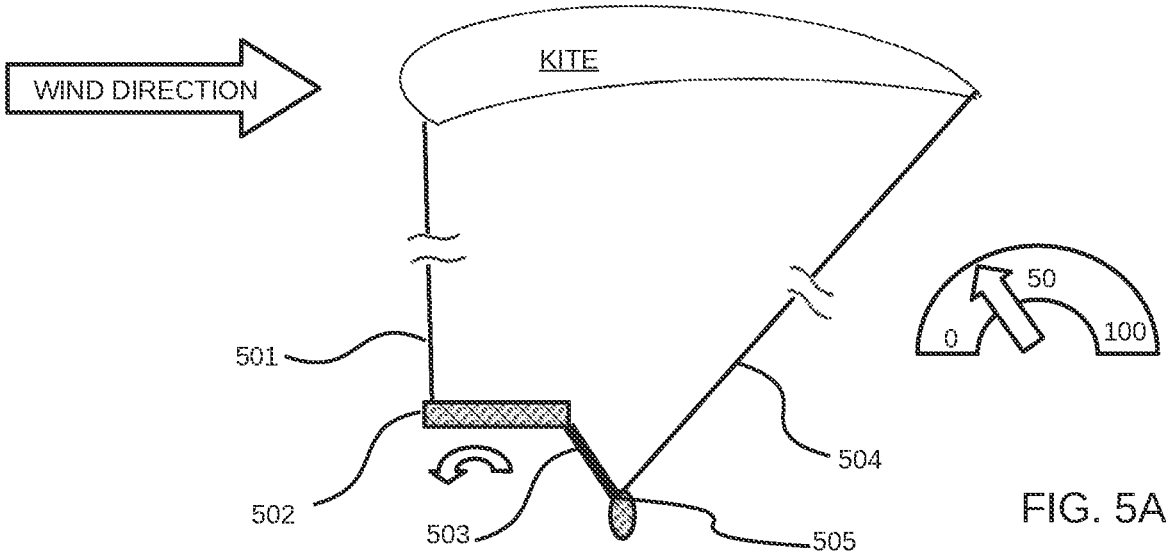

FIG. 5A presents an exemplar of a depower handle and kite with the handle in the horizontal, depowered position with the kite correspondingly horizontal to the wind flow.

Figure 5B:
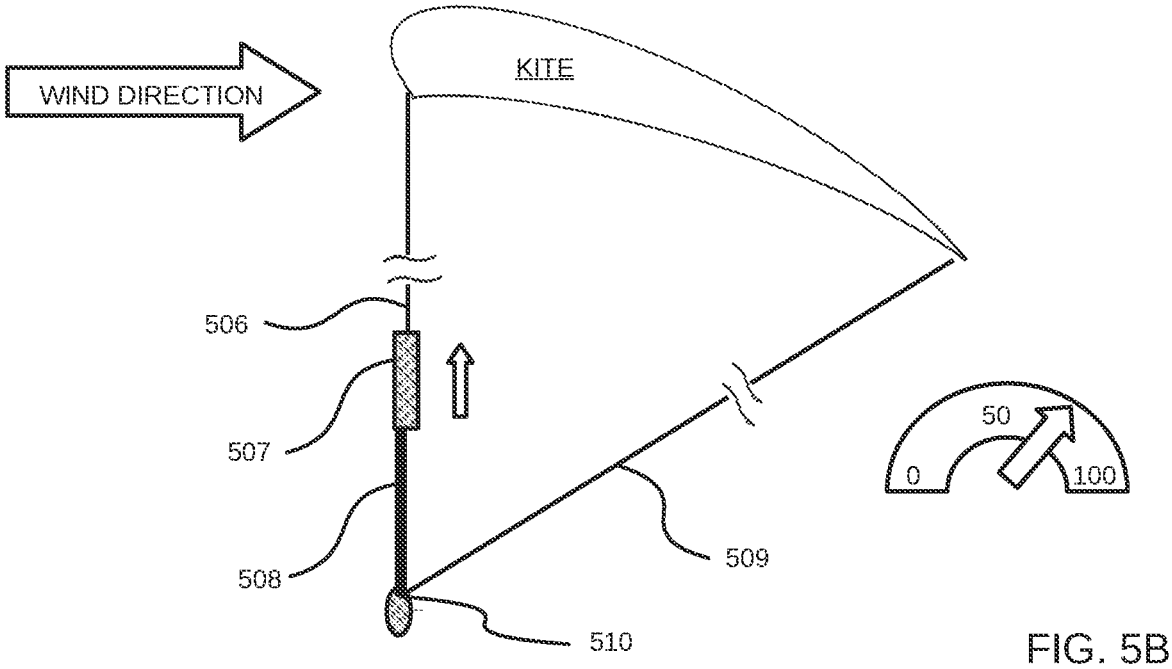

FIG. 5B presents an exemplar of a depower handle and kite with the handle in the vertical, powered-up position with the kite at a powered-up angle to the wind flow.

Figure 6A:
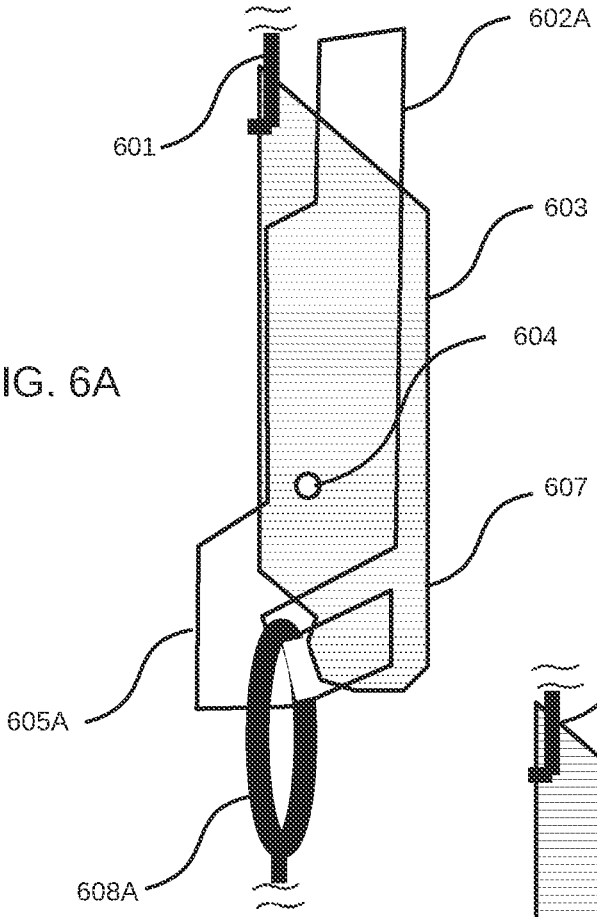

FIG. 6A presents an exemplar of a hand-actuated bailout trigger and depower handle in a closed and locked position while attached to a trim-cable assembly.

Figure 6B:
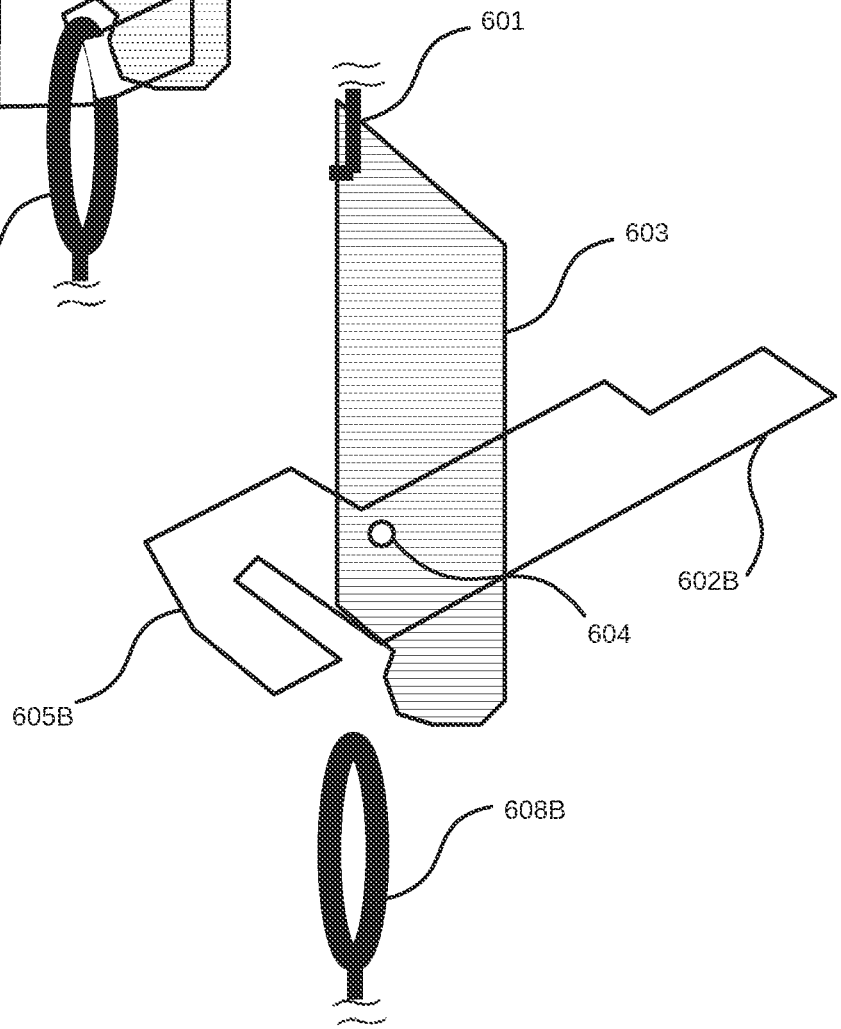

FIG. 6B presents an exemplar of the same hand-actuated bailout trigger in FIG. 6A in the deployed position, wherein the trim-cable assembly has been released.

Figure 6C:
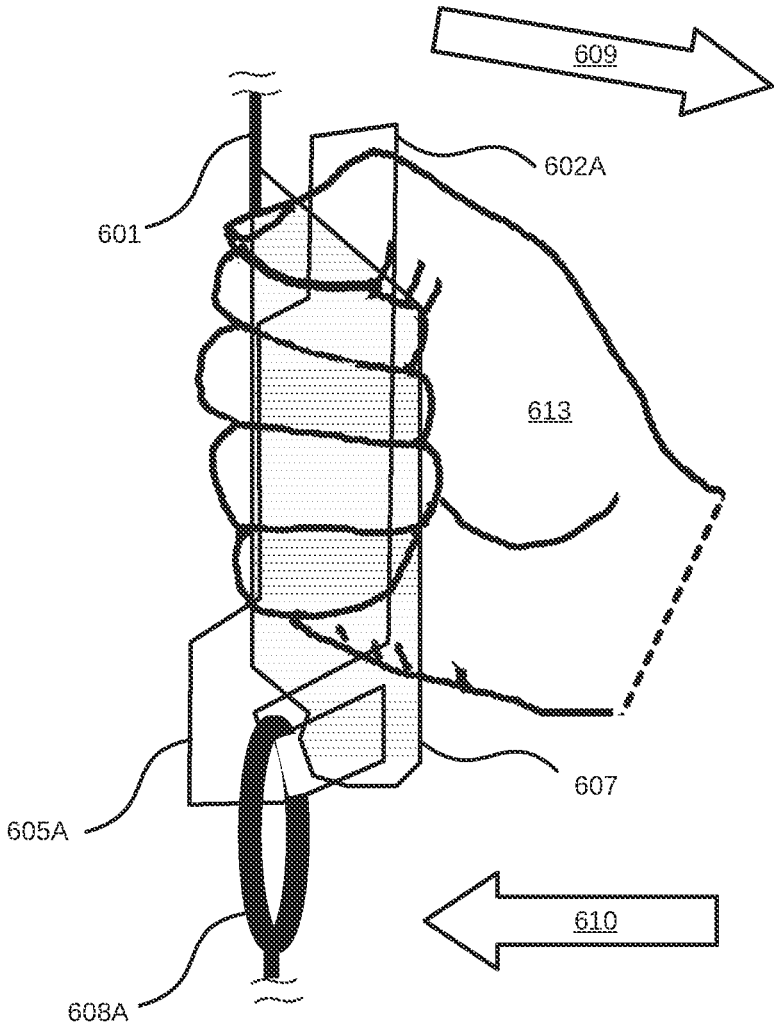

FIG. 6C presents an exemplar of a hand-actuated bailout trigger and depower handle in the locked position while being gripped within the right first of a kiter.

Figure 7B:
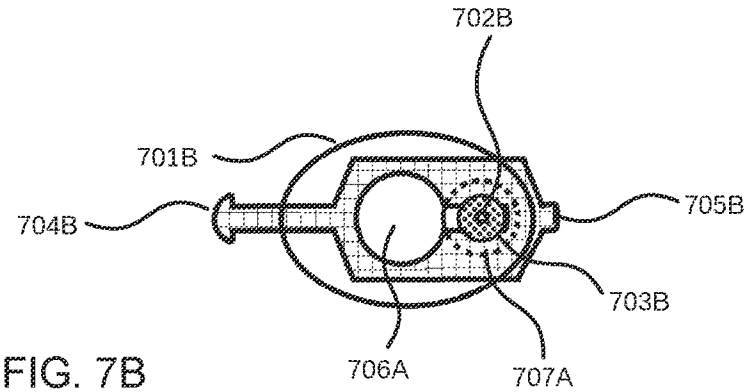
Figure 7C:
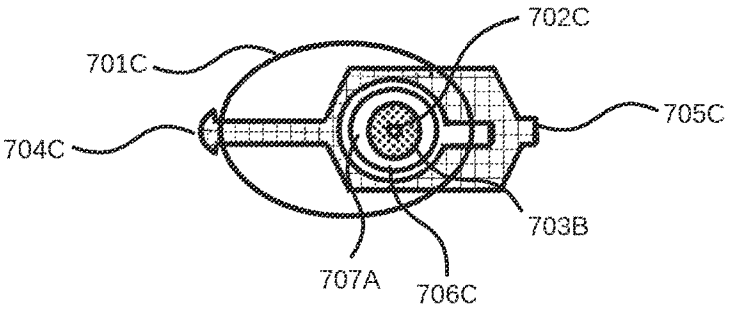
Figure 7A:
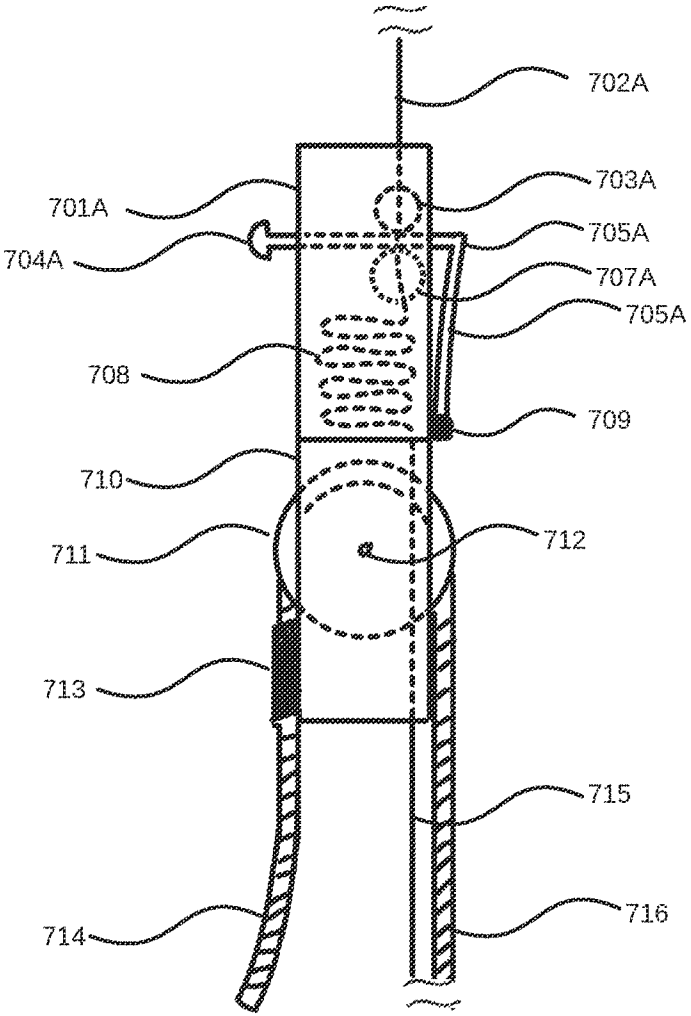

FIG. 7A presents a right-side view of an exemplar thumb activated bailout trigger combined with a depower handle, which includes an integral pulley and jam-cleat.

FIG. 7B presents a top-down view of an exemplar thumb activated bailout trigger combined with a depower handle, which includes an integral pulley and jam-cleat where the thumb trigger has not been pressed and activated.

FIG. 7C presents a top-down view of an exemplar thumb activated bailout trigger combined with a depower handle, which includes an integral pulley and jam-cleat where the thumb trigger has been pressed and activated.

Figure 8C:
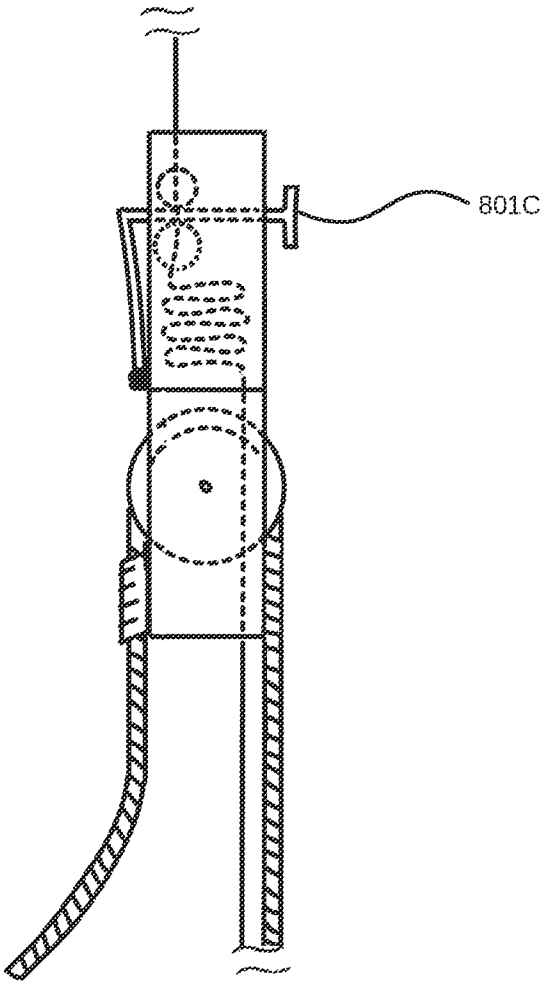
Figure 8A:
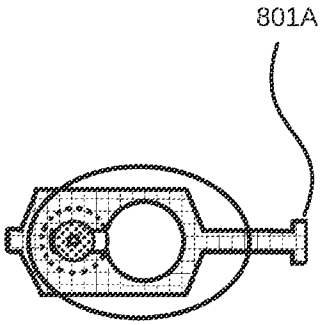

FIG. 8A presents a top-down view of an exemplar finger activated bailout trigger combined with a depower handle, which includes an integral pulley and jam-cleat where the thumb trigger has not been pressed and activated.

Figure 8B:
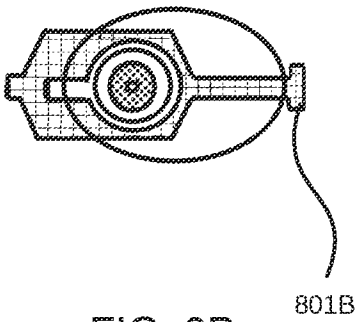

FIG. 8B presents a top-down view of an exemplar finger activated bailout trigger combined with a depower handle, which includes an integral pulley and jam-cleat where the thumb trigger has been pressed and activated.

FIG. 8C presents a right-side view of an exemplar finger activated bailout trigger combined with a depower handle, which includes an integral pulley and jam-cleat.

Figure 9A:
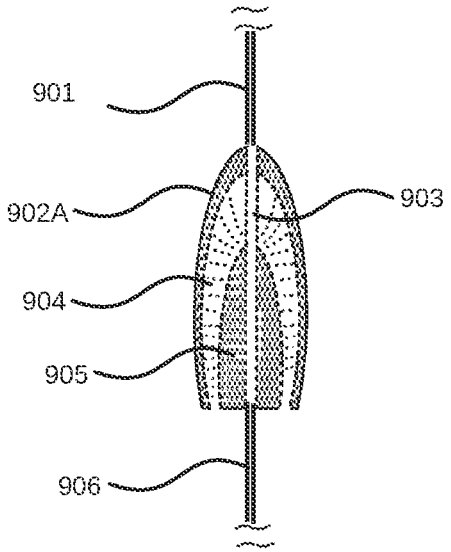
Figure 9B:
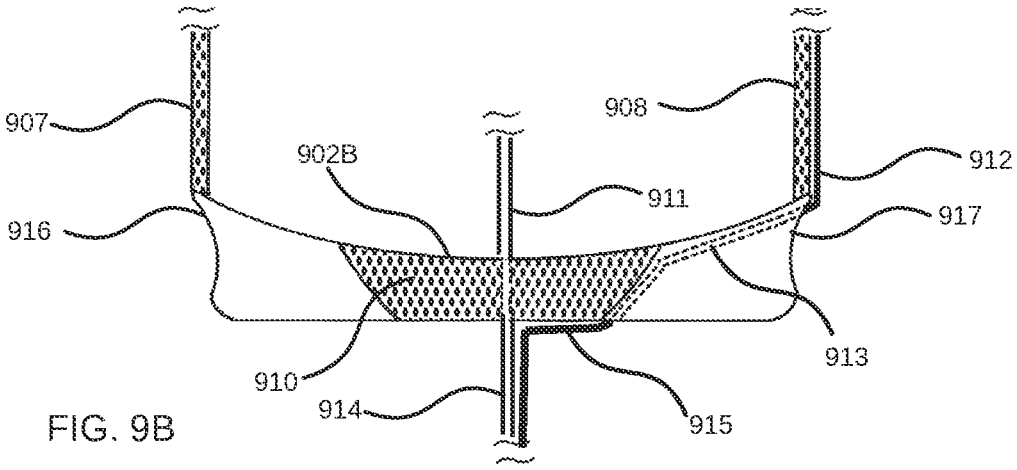

FIG. 9A presents a right-side view of an exemplar kite control bar, showing the inner surface of the bar, and an inner reinforcement portion, FIG. 9B presents a front view of the kite control bar shown in FIG. 9A, with steering strap-handles at the distal ends.

Figure 9C:
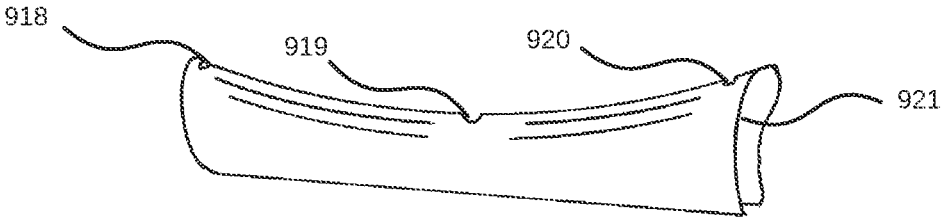

FIG. 9C presents a front perspective view of the same kite control bar depicted in FIG. 9A and FIG. 9B.

Figure 9D:
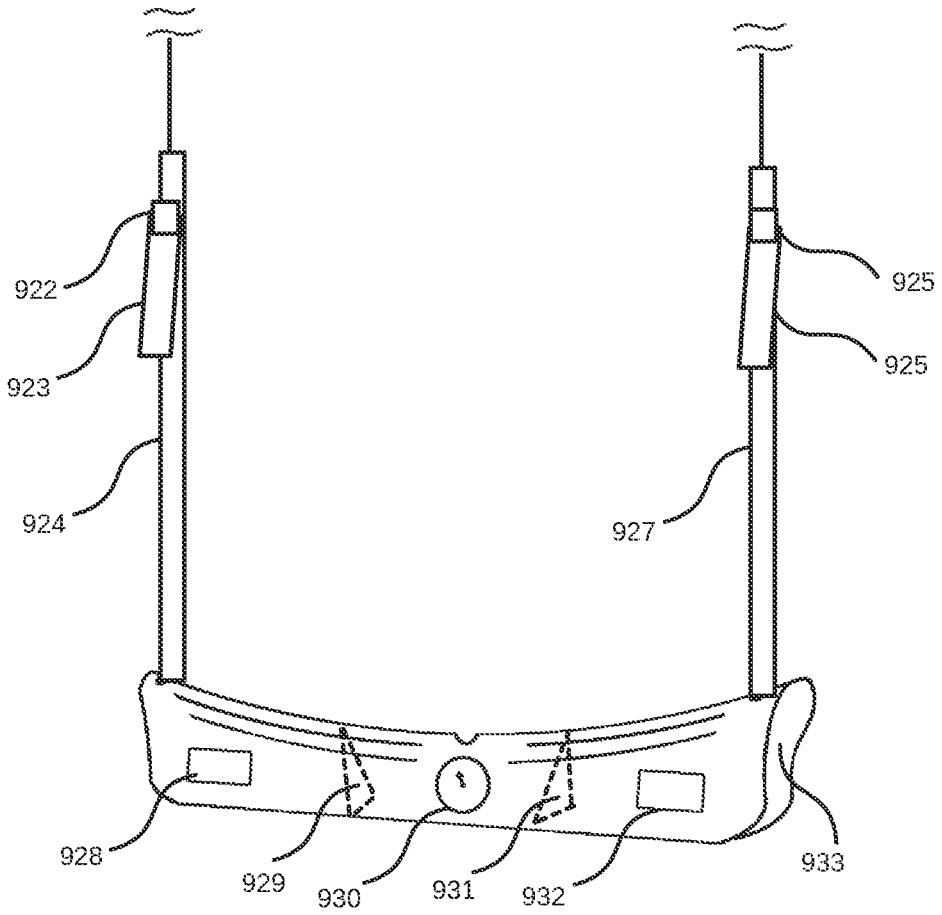

FIG. 9D presents a front perspective of a kite control bar with various gages and/or graphs and/or digital readouts, including two independently adjustable steering strap-handles.

Figure 10:
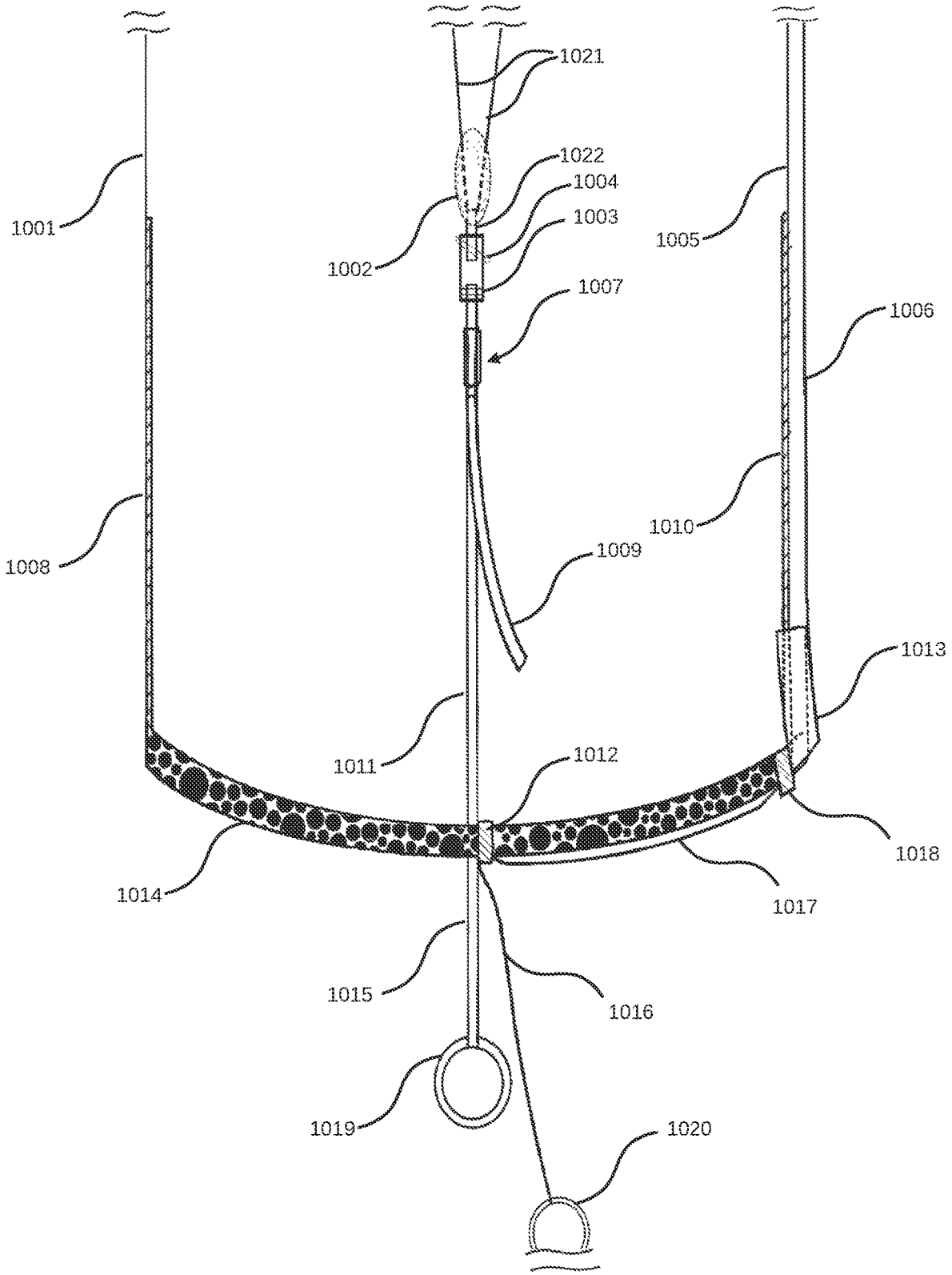

FIG. 10 presents an exemplar of a kite rigging control apparatus with a manual bailout trigger, but omitting a depower handle, wherein a kite recovery strap runs externally to the kite control bar or along a small channel on the kite control bar.

Figure 11:
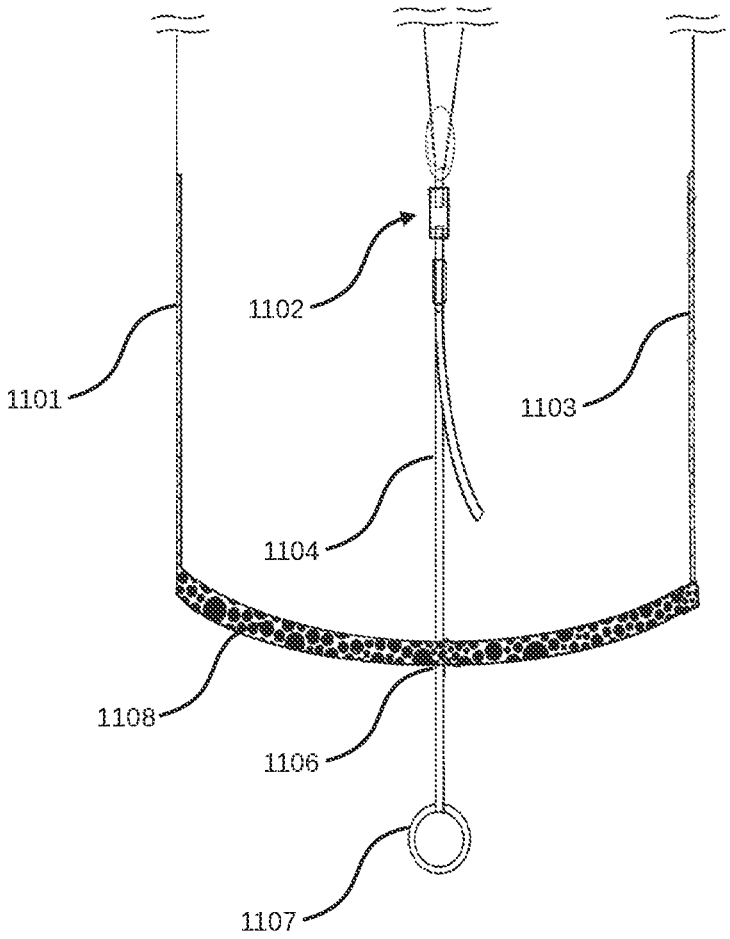

FIG. 11 presents an exemplar of a kite rigging control apparatus with a manual bailout trigger but omitting a depower handle and omitting a kite recovery strap.

Figure 12A:
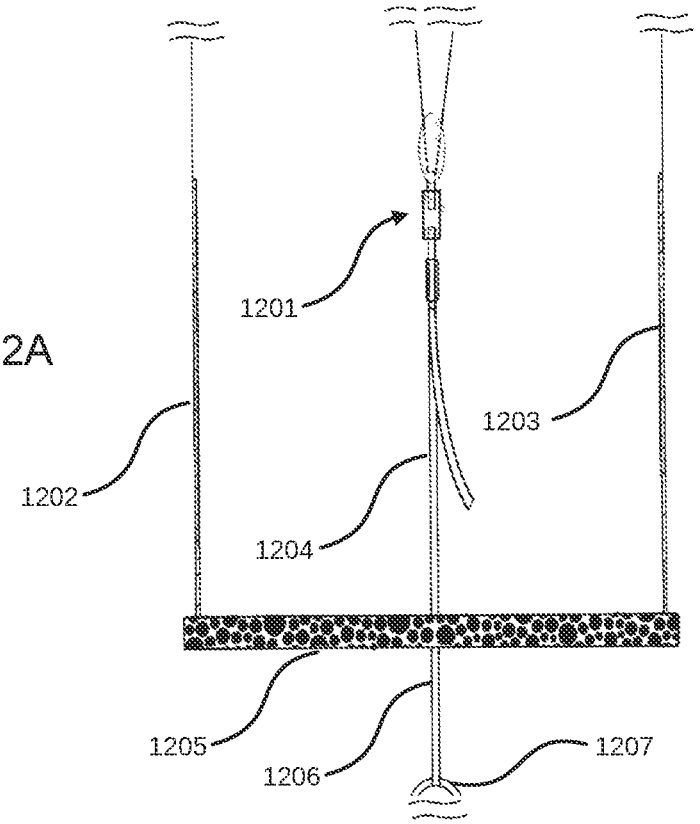
Figure 12B:
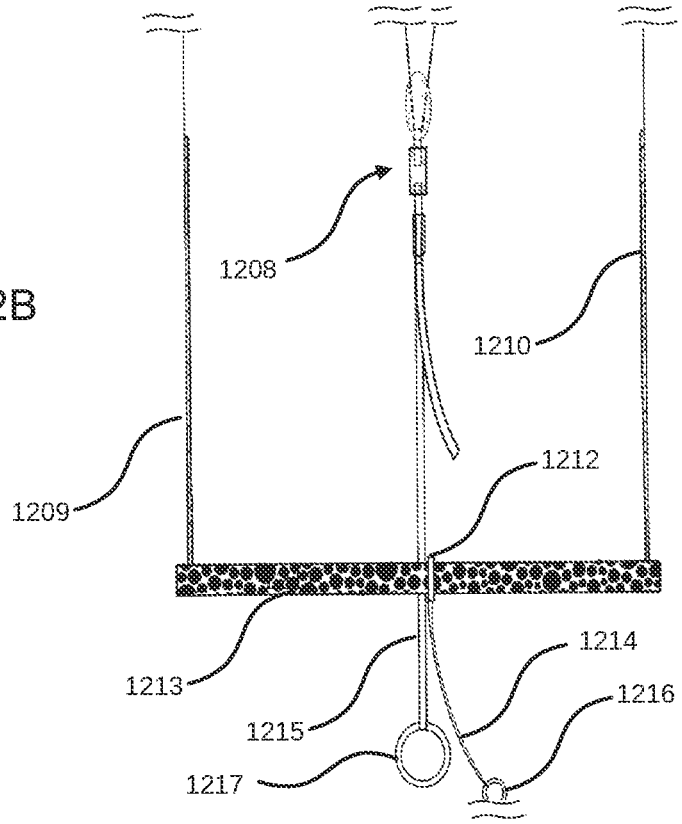

FIG. 12A presents an exemplar of a legacy style straight kite control bar with a manual bailout trigger but omitting both a depower handle and a kite recovery strap FIG. 12B present a legacy style straight kite control bar omitting a depower handle but including a sliding ring kite recovery system.

Figure 13A:
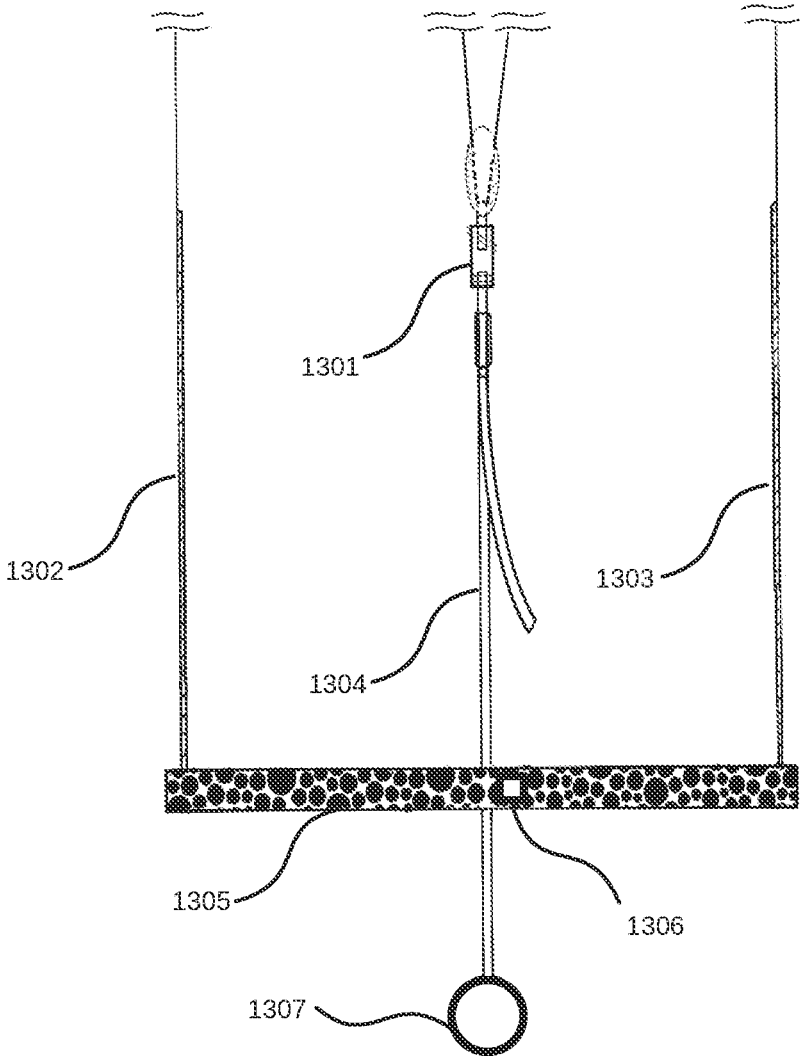

FIG. 13A presents an exemplar of a legacy style straight kite control bar with a manual bailout trigger with an electronic activation button, but omitting both a depower handle and a kite recovery strap.

Figure 13B:
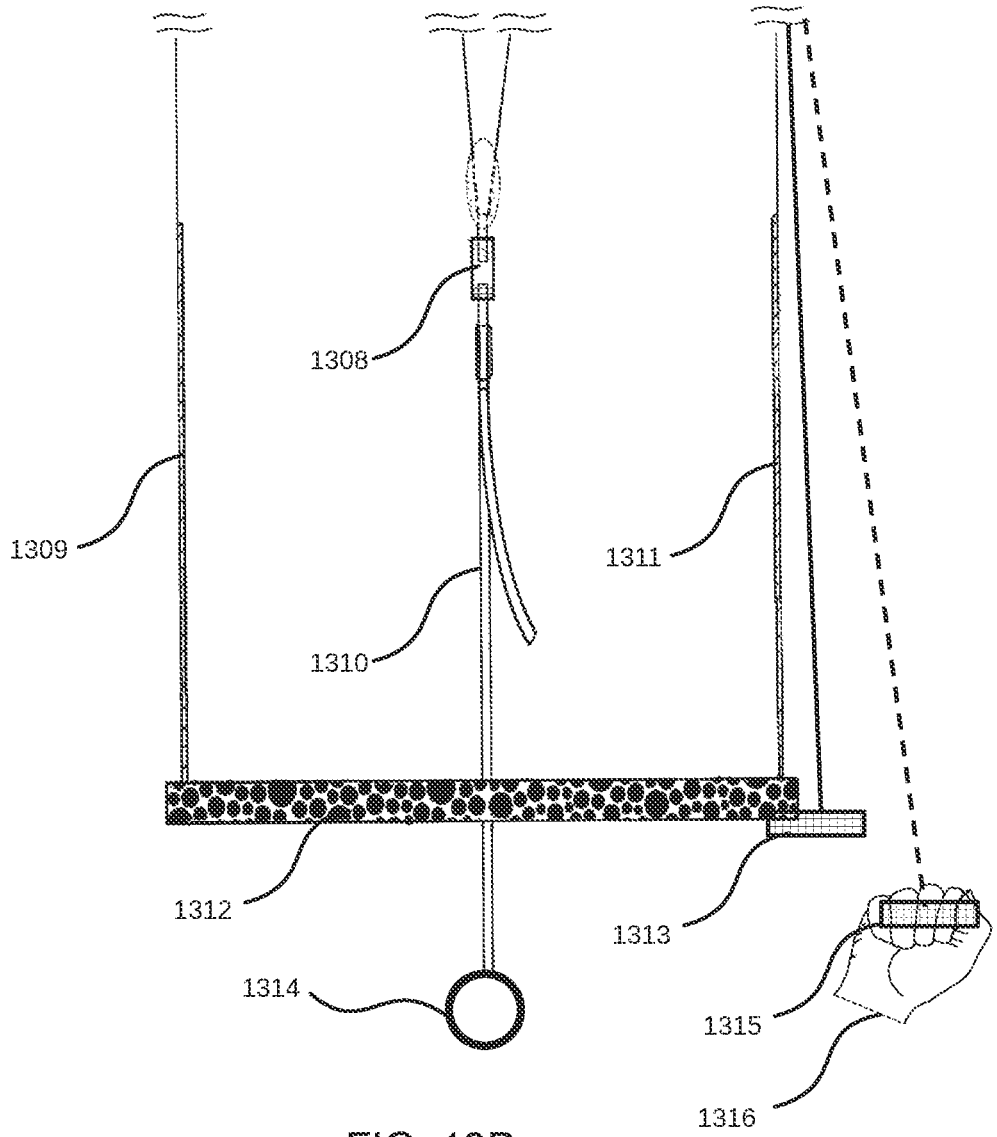

FIG. 13B presents an exemplar of a legacy style straight kite control bar with a manual bailout trigger but no depower handle with a kite recovery strap-handle that may be attached externally to the control bad.

Figure 14:
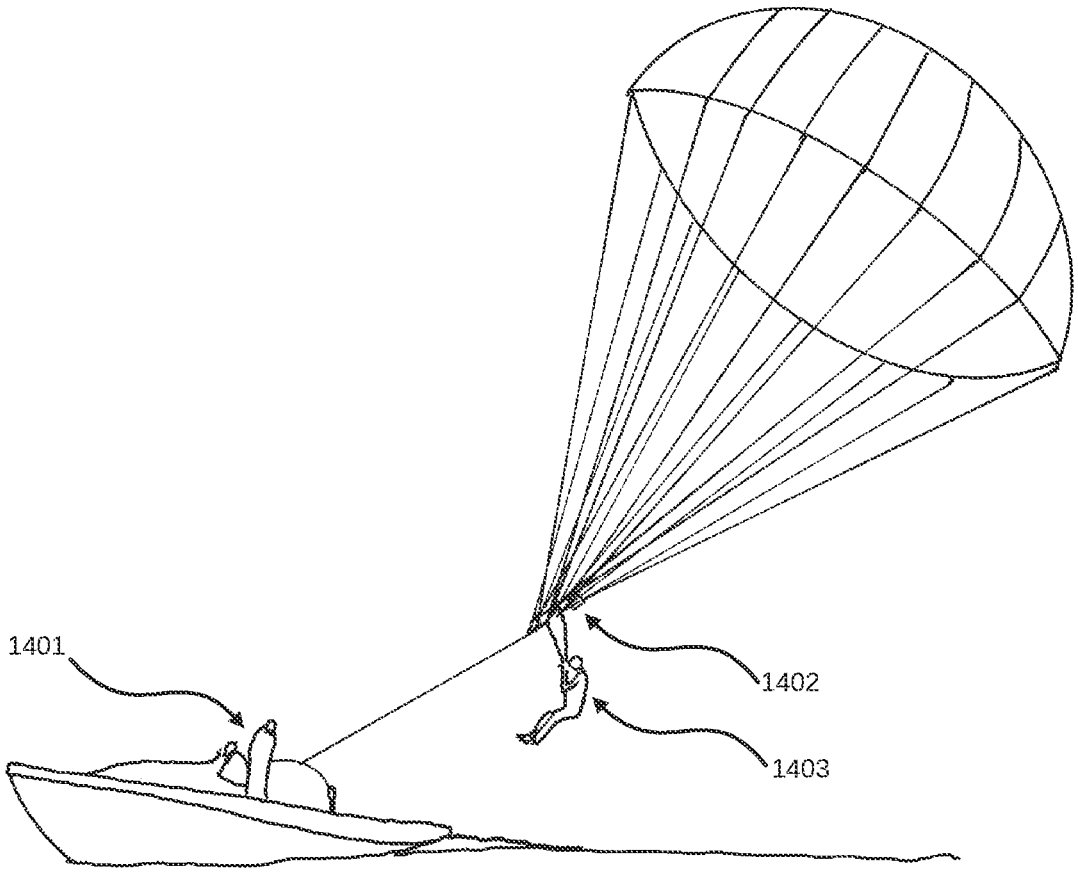

FIG. 14 presents an exemplar of a manual bailout trigger and or/depower system being used in the context of para-sailing.

Figure 15:
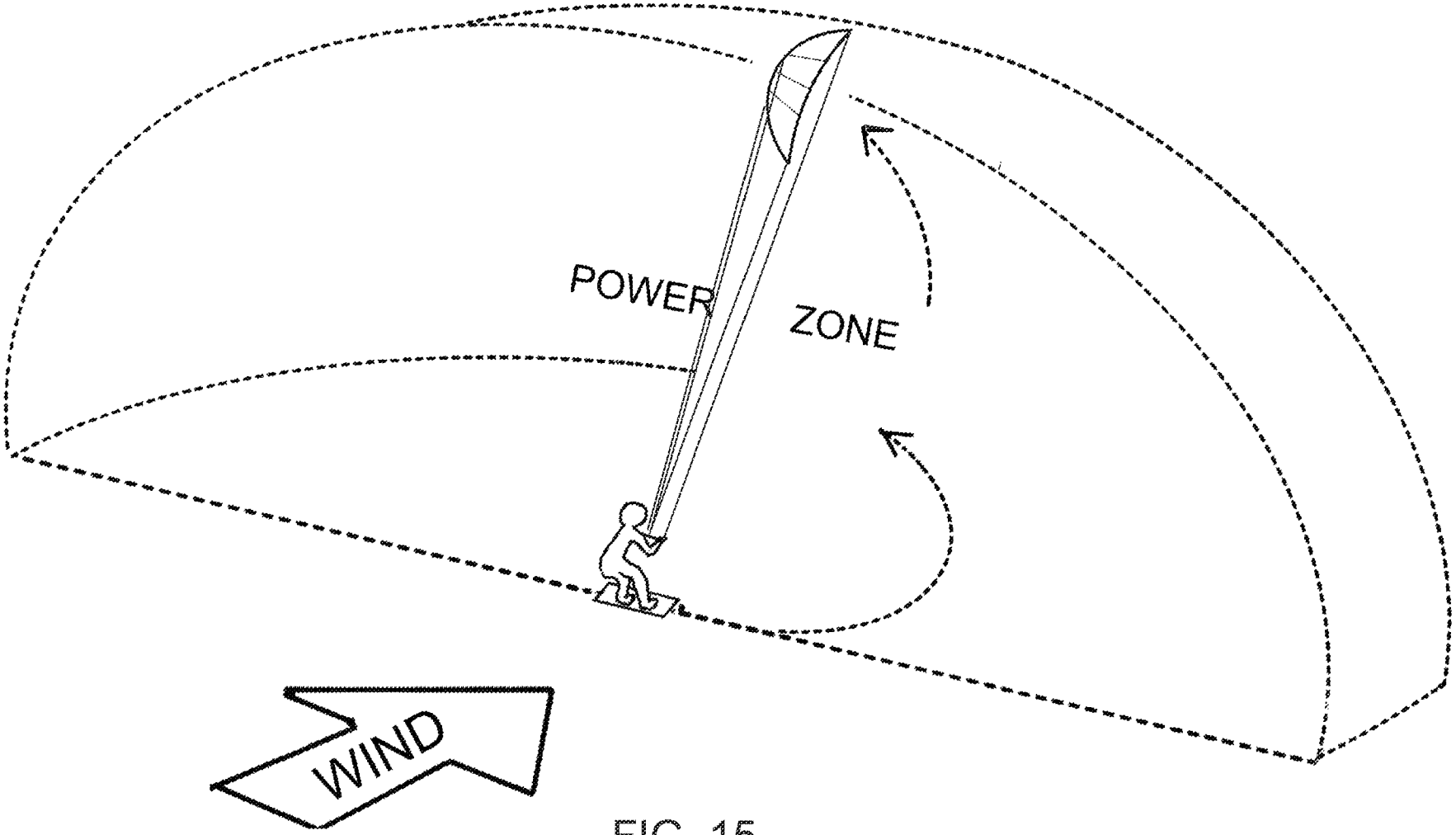

FIG. 15 presents an exemplar of a traditional kiteboarding transition being performed with a legacy kite rigging control apparatus.

Figure 16:
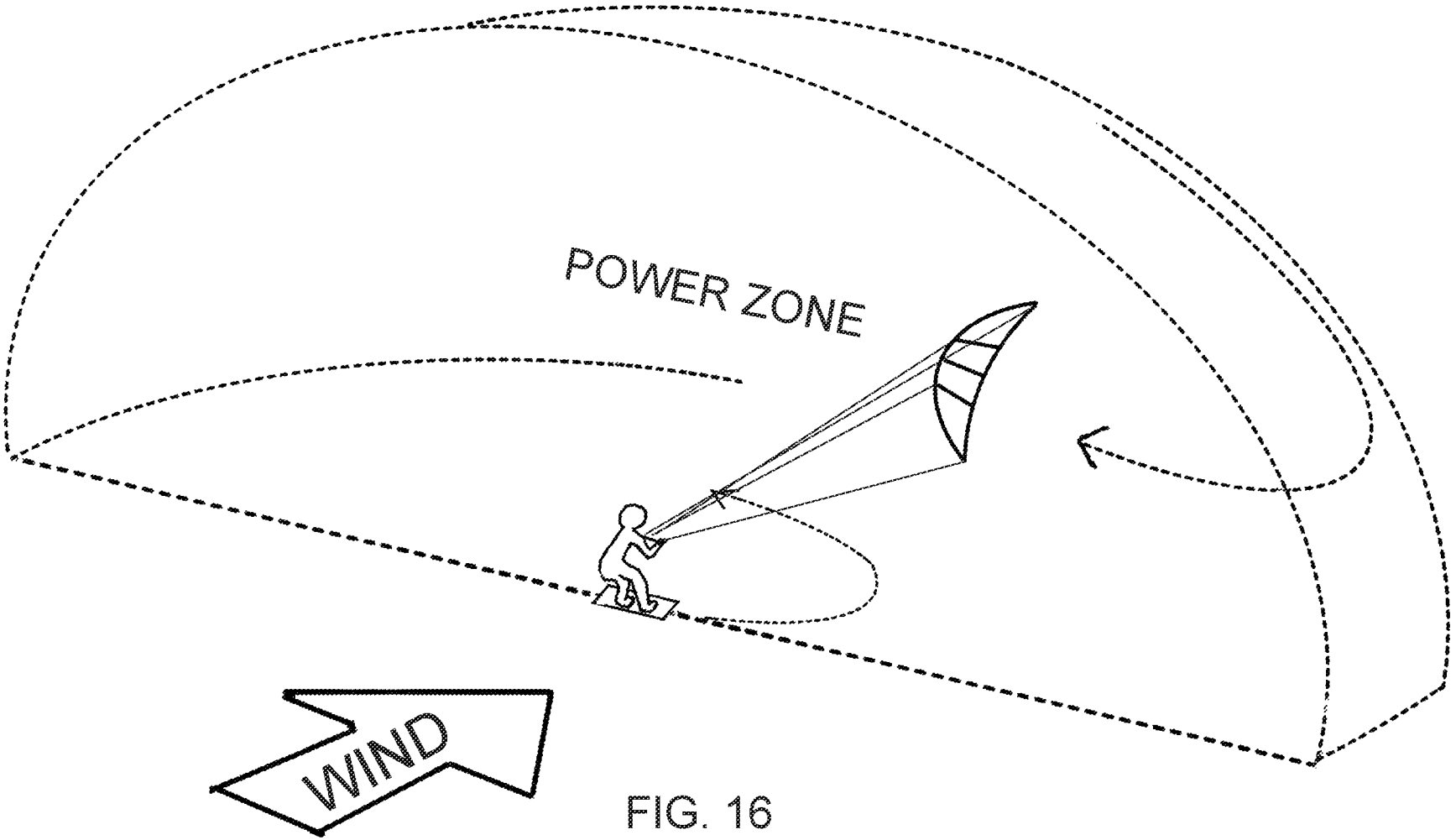

FIG. 16 presents an exemplar of an accelerated non-traditional down loop or power loop kiteboarding transition enabled by steering strap-handles.

DETAILED DESCRIPTION

Most serious or fatal accidents occur when launching or attempting to land a traction kite. A kiter may slip and lose their footing or be hit by an unexpected gust of wind while not in full control of their kite. Prior attempts to address these problems are woefully inadequate. This is because with the legacy kite control apparatuses, there exists no practical method of rapidly reducing the pulling power of the kite, or immediately releasing the kiter from the pull of the kite.

With legacy kite control apparatuses, the kiter must redirect their attention to from the kite and let go of the kite control bar with one hand, while blindly reaching below the kite-bar to manually activate a release attached at their waist. And even then, they are most often attached to a recovery line which runs through the core of the kite control apparatus and remains attached to the bridle of the kite. This may still allow the kite to continue looping, and thus continue to drag the unfortunate kiter.

Unfortunately, no kite control apparatuses exist that allow a kiter to manually and immediately release themselves from the pulling force of the power or center lines of an over-powered kite without breaking their visual attention on the kite. Also a depower handle that directly reduces the pulling power of the kite's power or center lines does not exist in the legacy kite control apparatuses.

Over the last two decades, traction kite control apparatuses have changed little since the inception of four-line kites. Four-line kites were a substantial improvement over the two-line kites that existed prior to their introduction. This is because they provided the ability to trim a kite horizontally in relation to the flow of the wind. This was introducing bridle lines to the leading edge of the kite by separating control between the bridle-lines and the steering lines. Heretofore, the only means of controlling the kite, was via two lines attached to the distal ends of the kite. Thus, the only relatively neutral position in which to fly the kite was to bring it directly over the head of a kiter to where the kite was relatively stationary in the noon position.

The noon position is still the default neutral position wherein the kite creates the least amount of pull. As stated, a major advancement was achieved when additional kite lines were added. These lead from the leading edge of the kite via a trim cable system, directly to the harness of the kiter; thereby separating control of the bridle lines and center lines from the steering lines. With this advancement, the kiter was now able to alter the horizontal trim of the kite relative to the flow of the wind thereby substantially reducing the pulling force of the kite.

It is important to keep in mind the profound difference between the power potential of a traction kite and a statically mounted sail. The principle of "true wind" versus "apparent wind" is a major consideration. Because a kite can be moved independently from where it is being controlled on its flying lines, a kite will generate much greater apparent wind over its surface area, when compared to a statically mounted sail; where the speed of the apparent wind over the sail is limited to that generated by the speed of the vehicle to which it is attached. Because the independent movement of the kite through the air generates apparent wind that directly correlates to its speed through the air and is thus not limited by the speed of the vehicle to which it is statically attached, it also generates exponentially much more power.

Additionally, gravitational effect on a swooping kite will create a radical increase in power, which occurs when a tethered kite dives from up high towards the water. This is what is commonly known to legacy kiteboarders as a "power stroke." A power stroke is often needed to initiated planing on a kiteboard, or to get a hydrofoil board or vessel up out of the water and "flying." A hydrofoil is deemed to be flying when the board or vessel to which it is attached is no longer in contact with the surface of the water.

Over the last few decades, many kiters have lost their lives or suffered serious injuries when they have been unable to detach themselves from an uncontrolled traction kite. In fact, the uncontrolled looping of a traction kite has come to be known as "death-looping" because the kite is flying in a large spiral and generating tremendous apparent wind, as it drags the unfortunate kiteboarder. Death-looping may occur under various circumstances: 1) while launching the kite; 2) when losing footing or tripping while traversing towards the water; 3) after unexpectedly being hit by a strong, unexpected gust of wind; 4) when attempting to self-land a kite while over-powered or in gusty conditions; 5) should a kiter's rigging be struck or entangled by a runaway kite, or; 6) when one of the kites lines unexpectedly breaks.

In the context of kiteboarding, once the kiteboarder is on the water with an open expanse of water before them, any loss of control over the kite can most often be recovered from without suffering a loss of life or serious harm from being flung against a rigid object by an uncontrolled or uncontrollable kite.

With the current legacy designs of the kite rigging control apparatuses most kiters may not even attempt to self-launch or self-land their kites. This is because two major flaws exist in the current designs.

First, once a kite is in the air, there is no quick way for a kiter to break away from the tremendous lifting power a kite can generate if it should be hit by an errant gust of wind. This is because the center lines that connect to the leading edge of the kite are attached in one tensile continuum through an orifice in the kite control bar and then down to an attachment point at the waist of the harness of the encircling the kiter. A kiter must therefore let go of the kite control bar with one hand to activate a release at the harness attachment point, which is almost impossible if a kite begins to lift a kiter off the ground.

What is needed is an easily accessible methodology to instantly release the kiter from the tremendous lifting power of the kite.

The second major flaw is that it can be difficult to self-land a kite. Many experienced kiters may never attempt a self-landing. Most kiters will always need someone else to catch their kite, control it, and then lay it on the ground with the leading edge into the wind.

Should a lone kiter come ashore on a beach after the wind has increased to where they cannot prevent themselves from being uncontrollably lifted into the air, their only recourse, short of releasing kite and rigging to the wind; is to release their kite control bar, while depending on a safety leash attached to their harness to restrain the kite.

Even under these circumstances there exists no real ability to "flag-out" the kite once the kite has been brought to the ground because of the aforementioned continuum of tension between the leading edge of the kite and the kite harness, even with the attached safety leash, this continuum is only momentarily broken. This is because the kiter is still attached through a tensile line to the leading edge of the kite, and the kite is thus still in danger of flying into the air and spiraling or death-looping as it drags the kiter behind it.

It is not an uncommon occurrence at many kiteboarding locations (since kiters often rely on storms for sufficient wind) for the wind to increase from 15-20 knots of wind to over 30 knots of wind while the kiteboarder is on the water. Because of the exponential increase in wind power, this means the kiteboarder seeking the safety of the shore is confronted with a wind that is much more powerful as when they first entered the water.

Finally, most kiters do not really understand that they have the ability to immediately depower the kite by grasping the center lines where they attach to a pulley and jam cleat. They don't really understand that they will change the horizontal aspect of the kite (FIGS. 5A and 5B) by doing this.

The present apparatus seeks to solve both of the major injury and potential death causing problems identified above, but this apparatus will also address additional flying control issue flaws as presented below.

Definitions and Use of Figures

Some of the terms used in this description are defined below for easy reference. The presented terms and their respective definitions are not rigidly restricted to these definitions—a term may be further defined by the term's use within this disclosure. The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application and the appended claims, the term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances. As used herein, at least one of A or B means at least one of A, or at least one of B, or at least one of both A and B. In other words, this phrase is disjunctive. The articles "a" and "an" as used in this application and the appended claims should generally be construed to mean "one or more" unless specified otherwise or is clear from the context to be directed to a singular form.

Various embodiments are described herein with reference to the figures. It should be noted that the figures are not necessarily drawn to scale, and that elements of similar structures or functions are sometimes represented by like reference characters throughout the figures. It should also be noted that the figures are only intended to facilitate the description of the disclosed embodiments—they are not representative of an exhaustive treatment of all possible embodiments, and they are not intended to impute any limitation as to the scope of the claims. In addition, an illustrated embodiment need not portray all aspects or advantages of usage in any particular environment.

An aspect or an advantage described in conjunction with a particular embodiment is not necessarily limited to that embodiment and can be practiced in any other embodiment even if not so illustrated. References throughout this specification to "some embodiments" or "other embodiments" refer to a particular feature, structure, material, or characteristic described in connection with the embodiments as being included in at least one embodiment. Thus, the appearance of the phrases "in some embodiments" or "in other embodiments" in various places throughout this specification are not necessarily referring to the same embodiment or embodiments. The disclosed embodiments are not intended to be limiting of the claims.

Referring now to FIG. 1A. FIG. 1A illustrates an exemplar of a kiter flying a four-line traction kite at the "noon"

position. This is the most common position in which a kiter flies their kite after launching the kite, and before they proceed to the water's edge. As used herein the noon position refers to when the kite is as far overhead as possible, given then-current wind conditions. The noon position is where the kite is stationary and generally in its most neutral position, where the wind blowing across the canopy of the kite is at the true wind speed, and the wind is not accelerated by movement of the kite. Here, the center lines 101B are taut, as is the left side steering line 102B and the right side steering line 103B.

The force of wind does not increase in a linear manner, corresponding to its speed, but rather the force of wind increases exponentially, in contrast to a linear increase in speed. This fact is what makes a traction kite so dangerous: the smallest movement of the kite generates power as apparent wind over the kite increases correspondingly. And this is why a kiter, especially an inexperienced kiter keeps their eyes on the kite.

Here, in the FIG. 1A exemplar, the kiter is keeping his or her eyes affixed on the kite, as indicated by the broken line 120. Also within his or her view is the jam cleat and pulley system, location 110B, as further described below regarding FIG. 1B. Additionally, and most importantly, this location is where a bailout trigger/depower handle would be mounted on the present apparatus; as illustrated starting with the exemplar in FIG. 2A. If the bailout trigger/depower handle does not exist (as is the case with the legacy apparatuses) a kiter who needs to eject from the strong pull of a traction kite is forced to divert their attention away from the kite, as indicated by broken line 120, and towards the location of a quick release 109B. Here is where a ring or chicken loop is releasably attached to their harness below the kite control bar at their waist.

This need to divert their attention from the kite overhead causes a very dangerous situation wherein a kiter must take their eyes from the kite, as indicated by broken line 120. Thereby causing a situation that may become deadly should the kite swoop out of control. Moreover, as a nervous kiter instinctively clutches the kite control bar more tightly with both hands, they often forget about freeing one hand from the kite control bar to manipulate the quick release 109B at their waist. Thus, they grip the bar even more tightly as the now out of control kite launches them into serious injury or even death.

However, with the present apparatus, a bailout trigger/depower handle would be mounted in front of the kiter's face in the location where a jam cleat and pulley system 110B is depicted, and thus the kiter will not need to divert their attention very far from the kite above to activate a bailout trigger or manipulate a depower handle, or a combination of both, as depicted. Activation of the bailout trigger will immediately cease the pull of the power or center lines. The ability to maintain observation of the kite while activating the bailout trigger/depower handle will prevent needless injuries and save many lives that might otherwise be lost during the sport of kiteboarding; as has tragically been the case with the legacy devices in use over the last two decades.

Referring now to FIG. 1B. FIG. 1B illustrates an exemplar of a four-line kite 112 with a legacy rigging control apparatus. Two center lines 101A are attached to the leading edge of the kite at the leading edge or bridal attachment points 119, (or optionally to a bridal, not shown here) while the steering lines, left hand steering line 102A and right hand steering line, 103A are attached to each of the distal ends of the kite. Within the context of the present description, the centrally located lines are also known as power lines because so long as very little tension is applied to the steering lines, the power from the kite is almost solely transmitted through these center lines 101A.

The steering lines; left hand steering line 102A and right hand steering line, 103A are used primarily to steer the kite. Tension on the right hand steering line, 103A steers the kite to the right, and vice-versa. Generally, the only time that the steering lines, left hand steering line 102A and right hand steering line, 103A are required to take on a substantial load, is when a kiter "sheets in" evenly on both steering lines to launch themselves skyward; sometimes while performing a "transition." A transition is a redirection of the kite, in order that the kiter can change direction of travel from port to starboard tack, or vice-versa.

While performing a transition, the traditional and current method is to fly the kite upwards and then in the opposite direction. (see FIG. 15). When this is done quickly, while the kiteboarder is moving in the opposing direction, the kiter may "jump" into the air. However, they are not jumping as a windsurfer would when launching off a wave, but rather they are being sucked or lofted into the air by the kite as it is flown in the opposite direction of travel and skyward, in a direction opposing the kiter's trajectory.

Referring back to FIG. 1B. What is not shown in FIG. 1B, is that some legacy kite rigging apparatuses, beginning in about the year 2000, incorporated what is known as a "chicken loop." This was called a chicken loop, because it came with the inception of using four lines instead of two lines to fly the powerful traction kites. Initially, in the highly macho world of the extreme sport of riding behind a two-line kite with almost no ability to depower; a kiter was considered a "chicken" for flying a four-line kite that could be somewhat depowered with a chicken loop that was connected to the center lines that changed the horizontal aspect of the kite. One example of depowering the kite is to change the aspect of the kite from flying in a more vertical position to a more horizontal position. Two elements in the legacy kite control apparatuses allow for this. The trim cable allows the kite to adjust to a fixed aspect, while the chicken loop, which is attached to the waist and then run through the kite control bar allows for continuous readjustment of the vertical to horizontal aspect by slacking of the steering line. For example, in FIG. 5, these aspects are illustrated in context of introducing a depower handle in the present kite control apparatus (analogous to what is shown in FIG. 5).

Additionally, this chicken loop could be readily detached from the kiter's harness, so that the kiter could then fly the kite solely based on arm-strength, since they would then have the kite detached from their harness. To this day, the very athletic young kiters often prefer to detach their harnesses completely from the kite control apparatus, i.e. kite control bar, so that they have this freedom of movement when launching into "jumps" or making "handle-pass" transitions, similar to what wakeboarders who ride behind boats include in their retinue of performances.

Moreover, for the majority of kiters who do not like to detach their chicken loops from their harnesses, there is a mechanism labeled as a "chicken loop lock," or loop lock 231, front view FIG. 2C1 and side view FIG. 2C2, 260. This mechanism prevents the chicken loop from accidentally detaching from the harness of a kiter, which can be a frightening occurrence for a kiter who never flies their kite unhooked. This is because if a kite is not fully depowered by having the trim-cable (referring back to FIG. 1B, 105) fully retracted, the power of the kite will often yank the kite control bar from the kiter's grip.

Referring again to FIG. 1B, the legacy apparatus: The center lines 101A are usually attached to a swivel 114 which is connected to a pulley and jam cleat system 110A. The pulley and jam cleat system 110A allows adjustment of the length of the trim-cable 105 by pulling on or releasing the trim cable through the jam cleat by the bitter end 106 of the trim-cable 105. The trim-cable 105 runs through an orifice at location 118 at the center of the kite control bar 113, together with a recovery strap 107, which is usually attached at an attachment point 104, to only one of the two center lines 101A. In some legacy rigging apparatuses, this recovery strap 107 is housed within a tube (not depicted) which also houses the trim-cable 105. This tube, found on legacy kite control apparatuses, prevents chafe to the trim-cable and the recovery strap as they ride within the orifice FIG. 1B at location 118, in the kite control bar.

A major flaw inherent in these legacy rigging apparatuses occurs because the recovery strap is attached to just one of the center lines FIG. 1B, 101A, and it is positioned at what is also the core of the rigging apparatus where the center lines 101A converge at a swivel 114, when there is an inevitable twisting of the rigging apparatus, and thus, this generally creates a contiguously un-releasable connection to the kiter's harness. The only remedy with these legacy rigging apparatuses under these circumstances is for the kiter to reach below the bar; where the entire apparatus is connected to the harness and manipulate a quick release FIG. 109B at the front of their waists'. This is an almost impossible feat for a kiter who is being dragged by an out-of-control kite.

The present rigging apparatus remedies this dangerous flaw because a hand-actuated bailout trigger mechanism is connectably mounted within ready reach and within view of the kiter FIG. 1A, 110B, even while the kiter may be dragged or pulled into the air by an out-of-control kite. Within the context of the present description, a hand-actuated bailout trigger and or combination bailout trigger/depower handle may be construed as any connectably attached quick release mechanism that may be a means of quickly separating the trim-cable assembly from the center lines. Such means may be composed of, but shall not be limited to, a clasp made of metal, carbon fiber, fiberglass, plastic, wood, a Velcro closure, a metal snaps closure, or a quick release knot. The goal being that the center lines remain fully secured to the trim-cable but under the control of the kiter so that the center lines can be quickly separated from the trim-cable. In further specificity, a particular goal of a hand-actuated bailout trigger mechanism is that a single or any of a plurality of center lines remain fully secured to a trim-cable while under control of a kiter such that the plurality of center line(s) can be quickly separated from the trim-cable.

In addition to this, the hand-actuated bailout trigger mechanism may also consist of a depower handle which the kiter may already have within their grasp. (FIG. Series 3 A-C, FIG. Series 4A, FIG. 4A-C, FIG. Series 6A-C, FIG. Series 7A-7C, FIG. Series 8A-8C.) As depicted, this depower handle will facilitate an easy triggering of the hand-actuated bailout mechanism, should the kiter fail to adequately depower the kite, and still need to release themselves from the power of the kite. This depower handle component may be made of a buoyant material such that should the trigger be activated while in the water, the buoyancy of the depower handle will keep it on the surface, and thus facilitate recovery.

Referring back now to both the legacy rigging apparatus FIG. 1B, and the present rigging apparatus, FIG. 2A. Both apparatuses also consist of a final recovery strap FIG. 1B, 107, FIG. 2A, 206A and 206B. This is a final recovery mechanism, since once the kiter has fully released themselves from the kite control bar and the kite, this recovery strap is intended to keep the kite from completely flying away and causing harm to others or to property or to damaging the kite.

In the legacy apparatus and the present apparatus, the actual recovery straps, respectively FIG. 1B, 107 and FIG. 2A. 206A and 206B, may consist of flat strap of Dacron (or similar) material at the lower end, and (solely) with the present apparatus it may merge with a length of kite-line at the upper end where it attaches to a point along one of the steering lines FIG. 2A, 221. The lower portion may consist of a flat strap so that the kiter may more easily handle the kite that is flagged out and flapping at the end of the line without injuring their hands, and the thinner upper kite-line section may be desired in order to reduce the windage (wind-friction) as the kiter sails across the water.

As used within the context of the present description, the terms lines, cables and straps are not definitively descriptive, but rather, the terms are used to distinguish various elements of the kite rigging control apparatus.

Referring again to FIG. 1, with the legacy kite rigging control apparatus, the trim-cable 105 functions to adjust the power of the kite 112 by adjustably shortening the center lines 101 attached to bridal attachment points 119 at the leading edge of the kite in relation to the steering lines, left hand steering line 102A and right hand steering line, 103A, thereby allowing slack in the steering lines. This in turn allows the kite to fly more horizontally to the flow of the wind and thereby reduce the power of the traction kite.

This is an initial tuning adjustment made using the jam cleat system 110A. However, dynamic depowering and powering up the kite is an ongoing process while kiting. The kiter accomplishes this by pulling on the kite control bar 113 or allowing the kite control bar 113 to slide up on the trim-cable 105, thereby releasing tension on the steering lines, left hand steering line 102A and right hand steering line, 103A. This is a dynamic adjustment that a kiter is constantly engaged in, to adjust the power and thus the pull of the kite 112. Allowing the kite control bar 113 to slide up, or by pushing the kite control bar away from the kiter, allows the kite 112 to fly on the forward center lines 101, which then causes the kite 112 to fly more horizontally in the sky above the kiter, thusly reducing the lift and power of the kite (see also FIG. 5A and FIG. 5B for a visual depiction). The aforementioned characteristics also apply to the present rigging apparatus as shown in one exemplar in FIG. 2A, and all other corresponding figures depicting trim-cables and their assorted parts.

Referring again to the legacy apparatus in FIG. 1B. The left hand steering line 102A and the right hand steering line 103A are attached at the distal ends of the kite control bar 113. The steering line set up on the present apparatus is analogous to this, with the exception that the present apparatus incorporates "steering strap-handles." These provide significant and substantial additional control when steering the kite FIG. 2A, 216 and 217, in that the steering strap-handles allow for a comfortable grip when handled That said, most kiters never take their hands from the bar, and solely use the kite control bar to steer the kite, or they hang from the kite control bar when lofting themselves into the air. In fact, most kite-school instructors train their students to never touch the SPECTRA/DYNEEMA kite lines, to avoid slicing their fingers. As illustrated on the legacy apparatus, the soft buoyant foam padding 115 and 116 through which the steering lines, left hand steering line 102A and right hand steering line, 103A are lead, are designed to both protect the kiter's fingers and to keep the kite control bar from sinking if it should be released while the kiter is on the water.

When changing direction; known as performing a transition; almost every kiter flies the kite upwards, against the pull of gravity, which slows the speed of the kite, as they turn their boards. Or a beginner, while riding a bidirectional "twin-tip" board, will stall their boards, and then reverse direction, while flying the kite upwards and then in the opposite direction (FIG. 15).

In contrast, the Inventor has developed a method of performing a transition wherein he flies the kite into a downward swoop FIG. 16, and then pivots the kite before it hits the water, using steering strap-handles (see FIGS. 2A, 2B, 9B, 9D, 10, 11, 12A, 12B, 13A, and 13B) attached to the distal ends of the kite control bar. A sharp pivot of the kite sometimes provides for a momentary reduction in power, as the apparent wind flow over the kite canopy is interrupted, but then power returns as the kite accelerates into and then through the "power zone." (FIG. 16).

Using this method of performing a transition, the kite generates a radical increase in apparent wind, as the kite swoops and then continues to accelerate through the power zone. The power zone FIG. 15 and FIG. 16 is the term used to describe the area of wind generally horizontally downwind from the kiter through which when the kite is flown it creates the most power, other than diving the kite down into this zone. Additionally, it is called the power zone because it is where the kite is flown with the leading edge almost perpendicular to the wind direction, which allows the kite to maximize the flow of wind over the kite canopy, and to accelerate the maximum amount of apparent wind across its canopy and thereby increase its pulling power.

Referring again back to FIG. 1B, the legacy rigging apparatus: In some circumstances the kiter may need to jettison the kite. In this case, kite control bar 113 is let go and a quick release shackle 121 under kite control bar 113 is activated, to release the rigging apparatus from the attachment point location 109A to the kiter's harness. What happens next is that the recovery strap 107 ostensibly slides through the kite control bar through an orifice at location 118, since the recovery strap remains attached to an attachment point 108, to a which a safety leash 111, of a comfortable gripping circumference, is clipped. This safety leash 111 is attached to the kiter's harness. There is also another manual quick release 117 that is an integral portion of the leash, which is used when a kiter needs to completely jettison the entire rigging apparatus. This might happen when being tumbled by a wave, or when the kite control bar 113 has been let go, and the kite 112 begins to spiral out of control, while dragging the unfortunate kiter, in what is commonly known as a "death loop" or a "death spiral."

The death loop or death spiral is the bane of all kiters. When a kite starts to loop or spiral uncontrollably, it generates tremendous power. This happens because the apparent wind is rapidly accelerated over the canopy as the kite accelerates, and this almost instantaneously and tremendously, increases the kite's pulling power. Indeed, over the last few decades quite a few kiters have lost their lives and/or been seriously injured because of this phenomenon. This is because they either did not, or could not, let go of their kite control bars when the kite began to loop, or even when they let go of the bar, the kite continued to loop, and they could not activate the manual quick release 117 that is an integral portion of the safety leash.

Unfortunately, with the legacy rigging apparatuses, this recovery strap 107 is ineffective and even dangerous to the kiter since it provides a false sense of security. This is for two reasons.

First, the recovery strap 107 is attached to one of the center lines 101A at attachment point 104. So once a kiter has released the kite control bar 113, using a quick release 121, and the slack is taken up on the recovery strap 107, since it is attached to one of the center lines. This center or power line is attached directly or indirectly via a bridle to an attachment point 119 at the leading edge of the kite 112; and even though the kite may be on the ground, the kite may still instantly relaunch back into the wind since it is tethered to the kiter by the safety leash 111. Once the kite relaunches, and the kiter is not holding the kite control bar, the kite may begin death looping and dragging the kiter.

Second, the recovery strap 107 is attached at 104 to one of the center lines 101 with insufficient range of length, and the recovery strap 107 sometimes becomes entangled with a swivel 114 and the bitter end 106 of the trim-cable 105 at the "core" of the rigging apparatus. I refer to this as the core of the rigging apparatus, since this will be at the center of a tight spiral of lines, should the kite start looping while the kite control bar remains firmly clutched in the grip of the hapless kiter as they are being dragged by the out-of-control kite.

Referring now to FIG. 2A, the solution to this problem, which has persisted for at least the last two decades, is to have a hand-actuated bailout trigger 218, that may be combined with a depower handle 210 positioned at the center or core of the rigging apparatus. Once this readily available hand-actuated bailout trigger is activated, this separates the hand-actuated handheld bailout trigger 218/depower handle 210 from a pulley a core location 220, through which the trim-cable 205 runs (together with a jam-cleat [not shown]. This jam cleat allows for adjustment of the length of the trim-cable 205.

Activating the hand-actuated bailout trigger 218 then immediately cuts the pulling force of the kite 212. This is because this indirectly detaches the leading edge of the kite at the leading edge attachment points 219 from the kiter. Further, as the center lines 201, which are affixed to the hand-actuated handheld bailout trigger 218/depower handle 210 are then separated from the pulley and jam cleat system, the kiter will thusly be immediately released from the pulling power of the kite 212. The kite 212 is then only restrained by left steering line 202 and right steering line 203. These are still attached to the kite at its left-side distal end, 224 and its right-side distal end, 225, and the steering lines 202 and 203, are also attached to the steering strap-handles 216 and 217; which are in turn attached to a first distally located attachment point 222 and a second distally located attachment point 223 at each end of the elongated kite control bar 213.

Once the kite control bar 213 is then fully released after the kiter activates a secondary quick release shackle 208, the recovery strap 206A remains attached to only one of the steering lines; here the right steering line 203, where it is affixed at location 221 (the left steering line is indicated by 202). This then allows the kite to "flag out" on the recovery strap (depicted by the broken line) since the right steering line 203 is attached at or very near the kite's right side distal end 225, and the recovery strap 206A is then in a position as depicted by the broken line 206B. Wherein the recovery strap as depicted by the broken line 206B remains attached to the kiter where it is attached at an attachment point on the kiter's harness 209. This ability of the kite to flag-out, while tethered to one of the steering lines 203 is a substantial improvement over the legacy rigging apparatus, since once the kite is flagged out on one of its distal ends, here at the right side distal end 225, it has very little pulling power.

This is in substantial contrast to the legacy rigging apparatus FIG. 1B wherein the kite is still contiguously attached to the kiter by one or both of the center lines 101A, and since that center line 101A will pull the leading edge of the kite 112 into the wind, and thus, the kite is still in danger of "relaunching" from the ground. Once the uncontrolled kite relaunches, it may drag the kiter into any unyielding obstacles, unless the kiter has the ability and the presence of mind to be able to release themselves completely from the apparatus by reaching to their waist and triggering the final release point attached to their harness FIG. 1B, 109, by activating a manual quick release 117 that is an integral portion of a safety leash 111 which in turn is affixed to the kiter's harness (not shown).

As mentioned, even if the kiter is able to release themselves from the kite control bar while flying the legacy apparatus FIG. 1B, they are still in danger of being dragged by their safety leash 111 (which is attached to their harness) because of the kiter's contiguous attachment to the center lines of the kite, which run to the leading edge of a kite; that then has a tendency to relaunch and then go into a death loop or death spiral.

Referring back to FIG. 2A, which is an exemplar of the present kite rigging apparatus. Should the kiter need to completely jettison the entire rigging apparatus, as may happen when in danger of being tumbled by a wave, there is yet another final release point 214 that is integrally mounted into the recovery strap 206A, now 206B (as indicated by the broken line).

Again, referring to FIG. 2A As with the legacy rigging apparatus illustrated in FIG. 1B, the center lines 201 are attached to the leading edge attachment points 219 at the leading edge of a four-line traction kite 212 or indirectly via a bridle to the leading edge of a four-line traction kite 212. And the left steering line 202 is attached to the kite 212 at its left-side distal end 224 and the right steering line 203 is attached to the kite 212 at its right side distal end 225.

A significant departure from the legacy kite rigging apparatuses is that the recovery strap 206A, instead of running through the hole at the center of the kite control bar 213, with all of the related problems articulated above, the recovery strap 206A runs along the underside, alongside, or within a channel under the kite control bar 213, and is attached to one of the steering lines 203 approximately indicated within the ellipse at location 221. Thus, in contrast to the legacy designs, should the kiter need to release the kite control bar 213, the kite control bar 213 will be released completely clear of the recovery strap 206A, thereby allowing the kite to fully flag out, as soon as the recovery strap 206A (as depicted by the broken line 206B) becomes taught.

This will occur without any chance of entanglement with the elements at the core of the rigging, approximately located at core location 220 and without there being any friction on the recovery strap 206A once it is in the position shown by the broken line 206B, which otherwise might impinge on its effectiveness. Along with the ability to immediately cut the pulling force of the kite using the trigger portion of the hand-actuated handheld bailout trigger 218/depower handle 210, this will substantially free the kiter from entanglement with the kite rigging lines, which has frequently lead to serious injuries and or death over the last two decades with use of a legacy rigging apparatus as depicted in FIG. 1B.

Moreover, with the present rigging apparatus, the rather cumbersome safety leash, FIG. 1B, 111 is eliminated since the recovery strap depicted by the broken line 206B remains attached to a part of a secondary quick release shackle 208 and (optional) swivel 215 combination. Further, when the secondary quick release shackle 208 is activated, this releases the kite control bar 213, and thus, all of the kite control apparatus except that the kite will remain restrained by the recovery strap, illustrated by the broken line 206B which remains attached at 204 to the opened quick release; which in turn is still attached to the (optional) swivel 215 and the attachment point on the kiter's harness 209. Additionally, this safety leash, 111, which is needed only with the legacy rigging apparatus, and not with the present rigging apparatus, is cumbersome because it sometimes tangles in the legs of the kiter. Moreover, in many of the legacy kite control apparatuses, this leash is attached to a strap or rope run horizontally across the back of the kiter's harness, which often results in a situation where the kiter is dragged helplessly backwards by an out-of-control kite.

The most significant and novel feature with the present kite rigging control apparatus is the "bailout" trigger, or more specifically the hand-actuated handheld bailout trigger 218/depower handle, 210. This hand-actuated bailout trigger 218 will allow an immediate release of power, since it simultaneously releases both of the center lines 201 as the depower handle 210 and hand-actuated bailout trigger 218 is released from where it is attached at core location 220 to the trim-cable. Thus, the kiter will be able to "bailout" of a bad situation. This action will be especially effective in situations where most serious injuries occur, as when the kiter is traversing to or from the water, when they might slip or stumble, or when their kite is struck with a strong gust of wind before they can reach the relative safety of "open water." Open water is a location where a kiter is not in immediate danger of being dragged onto land or into objects such as jetties, levees or wharfs.

Once the hand-actuated bailout trigger 218 is activated, and the kite falls backwards out of the air, the kiter may have time to activate a secondary quick release shackle 208 that fully releases the kite control bar 213 and the trim-cable assembly, said trim cable depicted above the kite control bar 213 at 205 and below the kite control bar at 207. (The bitter end 211 of the trim-cable 205 is used to adjust the horizontal trim of the kite.)

The kite will then flag out on the recovery strap 206A, as depicted by the broken line 206B, without friction and or entanglement issues since the recovery strap (depicted by the broken line 206B) will come completely free of the kite control bar 213, since it is not encapsulated in an orifice FIG. 1B, at location 118, as with the legacy apparatus in FIG. 1B. The present recovery strap depicted by the broken line 206B may releasably be held in place with Velcro straps (or a sacrificial material, like friction tape) under the kite control bar 213, or it may be held within a channel or groove in the bar. See FIG. 9 series and FIG. 10 for illustrations of exemplar channeled bars.

Additionally, the secondary quick release FIG. 2A 208 may not need to be manually activated, if an automatic release mechanism is incorporated into the kite control mechanism (see FIGS. 2C1, 2C2, FIGS. 2C3A and 2C3B), which depict two embodiments of exemplar automatic release mechanisms.

Finally, as with almost all of the legacy kite control apparatuses, should the kiter need to get entirely away from the kite and the rigging while using the present kite control apparatus, they may release the recovery strap, broken line 206B with a third and final release point 214 which is an integral portion of the recovery strap 206A. In the legacy apparatuses, this final release mechanism is an integral portion of a safety leash that is attached to the kiters harness FIG. 1B, location 117, where it is clipped onto a ring at attachment point 108.

Additionally, referring now to FIG. 2B, an exemplar is shown that includes an automatic system wherein once the hand-actuated bailout trigger is activated, and the leading edge of the kite 286 rises, as described above, a first part of a trigger line 283 that is contained within the manual bailout trigger/depower handle 282 (see also FIG. 3C) will be pulled out of the top of the bailout trigger/depower handle as the leading edge of the kite 286 rises, and pulls on a second part of the trigger line 226. The trigger line further runs through a kite control bar 227A, at location 227B and will then activate a second quick release attached to the harness of the kiter depicted within the broken line box, which is illustrated in FIG. 2C and described in more detail in the detailed descriptions for FIGS. 2C1, 2C2, 2C3A, and 2C3B.

As also shown in FIG. 2B, the kiter will then be able to retain the kite as it flags out on the recovery strap, 228A as it comes free of the kite control bar 227A and moves into the position shown by the broken line 228B, and where it is attached to the right side steering line at an attachment point 223, while still releasably attached to the harness of the kiter (not shown).

Referring now to FIG. 2C1. FIG. 2C1 depicts a closeup of what is shown within the broken line rectangle shown in FIG. 2B. This is a straight on view of an automatic release mechanism combined with a manual quick release handle 235 and a removable hook. The hook, comprising a first part 237, and a second part 240, intended for unhooked kite flying. What is shown is a lower portion of a trim-cable 229 from below where it runs through a kite control bar, (not shown here, but as shown in previous exemplars). A trigger line 230 is shown attached below the kite control bar, to an automatic release mechanism/manually activated quick release handle 235 that will automatically activate when the bridle portion 285 of the trigger line 230 is tensioned or pulled by the center lines of the kite (not shown) once a manual bailout trigger (not shown) is activated. This below the kite control bar automatic/manually activated quick release handle 235 can also be manually operated by the kite flyer in a way that is analogous to how many legacy below-the-bar quick releases that are found on the legacy kite control bars are operated. The trigger line 230 is shown attached to a bridle portion 285, which is attached at two attachment points 232A and 232B to the automatic release mechanism/manually activated quick release handle 235 (the outline of which, somewhat resembles an hourglass). The reason for at least two attachment points 232A and 232B is so that an even pull is exerted upon the automatic release mechanism/manually activated quick release handle 235 so as to facilitate a smooth and immediate automatic release.

Also depicted in this exemplar is an elastic member 234 akin to a shock-cord or a length of surgical tubing that keeps the automatic release mechanism/manually activated quick release handle secured in position over the inner trigger 236; which also allows for the manual separation of the trim-cable 229 from a stainless-steel hook mechanism without triggering the inner trigger 236. In yet other embodiments this inner trigger may be made of carbon fiber or other strong material. The elastic member is shown secured to a cross-member 238 of the stainless-steel hook, first part 237, and second part 240. This inner trigger 236 is better depicted in FIG. 2C2, which shows a side view of this quick release handle and removable hook mechanism.

The hook, first part 237 is shown in this exemplar with a loop lock 231 running through the hook, second part 240 to keep the hook firmly attached to a stainless-steel loop 284 that is attached to a "spreader bar" that is attached to the harness of the kiter. (A spreader bar is a rigid or semi-rigid elongated member that is attached to a harness, and it is designed to spread the pull of a kite, or other device to the sides of the harness [not shown])

A loop lock 231 is shown attached 239 to a crossmember 238 on the hook near a first part 237, wherein it can rotate on this crossmember 238 so that the loop lock may be removed from a second part 240 of the hook for those athletic kiters who prefer to unhook during certain previously described maneuvers.

Additionally depicted in FIG. 2C1 is a similar, yet much smaller manually operated final release handle 241A which is mounted on the recovery line, between where a (1) first part 240A of the recovery line runs up to a kite control bar (not shown), and where a (2) second part 242 of the recovery line to where it runs down to an attachment on the kiter's harness (not shown).

An expanded view of this final release handle 241A is shown to the right, as indicated by the two broken lines. As with the larger version of the automatic release mechanism/manually activated quick release handle 235 shown to the left, the manually activated final release handle 241A and (expanded view) 241B may be of a roughly hourglass shape. As with the larger automatic release mechanism/manually activated quick release handle 235, this shape facilitates a more secure grasp. The upper expanded portion 287 of the manually activated final release handle (expanded view) 241B, shows a distinct edge at the upper expanded portion 287. This may ensure an even more secure grasp on the relatively small release handle as the kiter pushes the handle away from them to activate the release or the recovery strap 240B. The inner trigger mechanism 243 is shown folded over the stainless steel or similar metal link 245. In yet other embodiments this link may be made of carbon fiber, titanium or other strong material. This inner trigger mechanism is shown in greater detail in FIG. 2C2 Both the larger automatic release mechanism/manually activated release handle 235 and the final release 241A, (and expanded view) 241B may use the folded over element as depicted in yet more detail in FIG. 2C2.

What keeps this manually activated final release handle (expanded view) 241B from sliding away from the folded over inner trigger mechanism 243 is an inward facing dimple 244 built into the plastic handle. This inward facing dimple 244 creates enough of a blockage to prevent the manually activated final release handle (expanded view) 241B from sliding off of the folded-over inner trigger mechanism 243, without applying some force by hand. Where the recovery strap, at 246 leads to an attachment point on the kiter's harness (not shown), the diamond patterned portion 246 may represent a splice in the line or strap used to affix the recovery strap to the stainless-steel or similar metal link 245. In yet other embodiments this link 245 may be made of carbon fiber, titanium or other strong material.

Referring now to FIG. 2C2. This exemplar shows a possible side view for the larger automatically triggered release/optional manual release handle 253, for the quick release handle 235 shown in FIG. 2C1. The trigger line bridal 251, is the same bridal depicted as 285 with the attachment point 252 representing the attachment point 232B in FIG. 2C1.

The handle FIG. 2C2, 253 for the automatic release mechanism/manually activated quick release handle 235 in FIG. 2C1, is shown from the side where the hourglass shape and the extended portion at the distal end of the automatic release mechanism/manually activated quick release handle 235 in FIG. 2C1 is not made visible from this side view.

What FIG. 2C2 shows in detail is one exemplar of how the folded-over hidden trigger mechanism may be constructed. The upper checked portion, represents a stiff metal, carbon fiber or other rigid plastic pin 255 that is inserted, either into a sleeve formed by the braided SPECTRA/DYNEEMA line 254, or in the case of the smaller final release handle 241A and in the expanded view of the smaller final release 241B as shown in FIG. 2C1, it may be a metal or carbon fiber, or other rigid plastic pin 255 inserted and affixed within a tubular strap 250 (analogous to a fire-hose). That tubular strap may serve as the much aforementioned flag-out recovery strap that attaches to one of the at least two steering lines of the apparatus.

Completing the side view representation of FIG. 2C1 in FIG. 2C2, the loop lock shown in FIG. 2C1, is shown here as loop lock 260, and it is spliced over a crossmember portion 257 of the first part 256 of the hook, shown here spliced over the same crossmember portion 257 of the hook at FIG. 2C1 238. The tip or second portion of hook 258 in FIG. 2C1 at 240 is shown here by the tip or second portion of hook 258. The same attachment point on the kiter's harness shown in FIG. 2C1, 284 is shown here by the checked patterned-half-ring attachment point 288.

To restate the purpose of this loop lock 260 and hook; this unhooking allows an athletic kiter to unhook from the kite at will, by moving the loop lock 260 securing mechanism to the side, which then allows the athletic kiter to disconnect the hook 258 (and attached automatically-triggered release/optional manual release handle 253), and then fly the kite while solely holding on to and managing the pull of the powerful traction kite with their arm muscles. And this is then accomplished without any support given by having the trim-cable affixed to an attachment point on the kiter's harness.

Although the described unhooked methodology of flying a kite was popular in the early days of traction kiting some twenty years ago, the much greater percentage of kiters on the water today, possibly ninety-five percent, fly their kites without every disconnecting their trim-cable portions from their harnesses while underway.

Referring now to FIGS. 2C3A and 2C3B. These depict a simple version of the previously described automatically triggered release/optional manual release handle. This is an exemplar of one that may be used by a kiter who never detaches (unhooks) their trim-cable assembly from their harness while flying their traction kite. FIG. 2C3A shows a straight-on view, and FIG. 2C3B shows a side view of the same automatically triggered release/optional manual release handle. FIG. 2C3A, 261 indicates where the trim-cable runs up and through the kite control bar. The trigger line is shown at 262 where it connects to the bridle (as described in the detailed descriptions for the previous series of figures).

In FIG. 2C3A, front view, the bridle 263, connects at the attachment point 264, this corresponds with FIG. 2C3B, side view elements 272 the bridle for the trigger line, and its attachment point 274. Also corresponding with front view FIG. 2C3A, 261 is the trim-cable where it leads down from the kite control bar side view FIG. 2C3B, 273. As depicted in previous figures, both the trigger line FIG. 2C3A, 262, and FIG. 2C3B, 272, run alongside the trim-cable FIG. 2C3A, 261 and FIG. 2C3B, 273. As previously depicted this trigger line is attached to the bail out trigger assembly, which when released will trigger this automatically-triggered release/optional manual release handle FIG. 2C3A, 265 and FIG. 2C3B, 275.

The manual operation of this exemplar of the automatically triggered release/optional manual release handle differs in its simplicity from the exemplar in FIG. 2C2, where a hook is needed so that that the kiter may disengage from the trim cable assembly and re-engage with the trim cable assembly while flying the kite.

Here, to disengage the automatically triggered release/optional manual release handle manually, the kiter must push the handle away from them, as with the legacy kite control apparatuses. The handle assembly FIG. 2C3A, 265 and FIG. 2C3B, 275 is held in position because a ridge (e.g., front view ridge 269 or right side view ridge 278) is directed inwards on the inside of the handle assembly 265 and 275. A folding metal (or carbon fiber or plastic) tab 266 and 276 has a raised dimple 268 and 277 on it. This prevents the handle assembly 265 and 275 from sliding off of the tab 266.

The tab FIG. 2C3A, 266 is connected to the trim-cable 261 and 273 because the trim-cable is threaded through an aperture in the tab and stopped at its bitter end 271 and 280. This tab is folded over the attachment loop 270, 281 that is attached to the kiter's harness.

In sum, this is a very simple automatically triggered release/optional manual release handle that allows for an automatic release, once the manual bailout trigger is deployed. This way the kiter is able to immediately release themselves from a kite that has become unmanageable by use of a second manual bailout trigger, and then the rest of the kite control apparatus is separated from the kiter, so that it will then flag out on one of the steering lines that remains removably detached through the recovery strap. Again, once the kite is flagged out by being tethered at one of its distal ends, its power is reduced as much as is possible, and it is not in the same danger of re-launching as with the legacy kite control apparatuses that have been extant for the last 2 decades.

Referring now to FIG. 3A and FIG. 3B. This drawing presents two views of one exemplar of a manual bailout trigger. Here it is combined with a "depower handle" (See also FIG. 5). This exemplar shows the trigger 302A and 302B that is partially contained with a depower handle 303. In both views, the center lines 301 leading to the kite is shown attached to the top of the depower handle 303, and the trim-cable 306 is leading down to where it slides through an attachment point on the kite control bar (not shown) to where it is ultimately attached to the kiter (also not shown here.)

The trim-cable 306 is run through pulley 304A and 304B or a friction-reducing "block". A friction-reducing block is essentially a pulley without moving parts. Although these devices have an ancient history, these designs have recently been resurrected in carbon-fiber or polished aluminum form for the sake of lightness and simplicity, for use in some very recent high-tech sailing craft. These devices are currently known as low-friction rings. Additionally, not shown, is a jam-cleat portion of the assembly which would be mounted lower on the trim-cable, and the bitter end 305 of the trim cable would actually be run through this jam-cleat. The view on the left side of the page shows trigger 302A in the locked position. The trigger 302A may also be further held in position with a rubber band, a Velcro strap or similar additional fixing mechanism (not shown here). FIG. 3B shows the trigger 302B after it has been activated. Once the trigger 302B is activated, the pulley FIG. 3A, 304A and FIG. 3B, 304B is released, together with the trim-cable 306, and trim cable bitter end 305 and all parts of the rigging apparatus mounted below this, including the kiter. In this exemplar, the trigger 302A and 302B is designed to smoothly slide from the kiter's hand once it is activated, as depicted in FIG. 3B. The trigger 302A and 302B is mounted on a pivot point within the depower handle 303 (not specifically depicted).

Referring now to FIG. 3C. FIG. 3C, depicts an exemplar of a manual bailout trigger 302 contained within a depower handle 303 with an added recovery line 307. The center lines 301 are connected to the leading edge of the kite, or the kite bridle (not shown), is shown attached to the top of the depower handle 303. The trim-cable 306 is shown at its bitter end 305 which would run through a jam-cleat (not shown) below the pulley 304. The other end of the trim-cable 306 runs down to where it slides through an orifice or an attachment point on the kite control bar (not shown) to where it is ultimately attached to the kiter (also not shown here). A recovery line 307 is shown where it is packed inside the depower handle 303. This recovery line as shown in this exemplar allows the kiter to reconnect the pulley 304 back to the manual bailout-trigger 302 without having to locate the detached pulley 304 separately from the center lines, should it have been released. This embodiment may be desirable in situations wherein the manual bailout trigger is deployed while the kiter is out on the water, and may under the right conditions, want to reattach the kite control bar, and other rigging apparatus, and then relaunch the kite.

Referring now to FIGS. 4A, 4B and 4C. These depict three different views of another exemplar manual bailout trigger and depower handle apparatus. This is a smaller lighter, and more compact version of the apparatus than what is shown in FIG. 3.

FIG. 4A illustrates a right-side view of the manual bailout trigger and depower handle apparatus where it is locked and suspended between the kite center lines 401 and the trim-cable 409A (no jam cleat assembly is shown here) where it runs through the pulley 407A and is attached to the harness of the kiter (not visible). The trigger consists of four portions, an inner strap 402, depicted by the patterned area extending above a sleeve portion 404A with a pivot pin 405A, and a pair of jaws 406A, in which a pulley 407A is held. The trim-cable 409A which would be attached to the kiter's harness (not visible); while the bitter end 408A of the trim-cable 409A remains free and is available for fine-tuning of the trim-cable assembly (as previously described in Paragraph 70).

FIG. 4B depicts a right-side view of the same manual bailout trigger and depower handle apparatus that is depicted in FIG. 4A, (and FIG. 4C) however, here the trigger 403B, and 406B has been activated so that the trim-cable and pulley 409B, 407B and 408B have been released, along with the kiter who would still be attached to the trim-cable assembly at their harness attachment point (not shown).

Here the activated manual bailout trigger and depower handle apparatus is depicted with the same four elements depicted in FIG. 4A. Visible are the inner strap 402, the sleeve 404B, the pivot pin 405B and the jaws 406B. The inner strap 402 is visible above sleeve 404B, as shown by the patterned area. Here, as mentioned, the trigger 403B, and 406B has been activated and the pulley 407B has been released from the jaws 406B, along with the trim-cable and pulley 409B, 407B and 408B which would remain attached to an attachment point on the harness of the kiter (not shown).

An additional element that is not shown here may be a recovery strap that would consist of a thin line, like a SPECTRA/DYNEEMA kite line. This may be attached between where the kite center lines 401 are attached and to the portion of the pulley 407B that is releasable from the jaws 406B. This thin recovery line may be held in a small bundle that is contained within a small fabric and Velcro packet that is attached to the kite center lines 401 just above the manual bailout trigger and depower handle apparatus, or it may be attached to the inner strap 402 of the bailout trigger itself, ready for deployment if necessary.

Referring now to FIG. 4D. FIG. 4D presents an exemplar of a manual bailout trigger in the form of a pipe section 416 and a depower handle 418 where the manual bailout trigger and the depower handle 418 are separate and distinct from each other. Two center lines left side 411 and right side 410 leading to the kite (not shown) run through a float 413, where they are both connected to a short rod 412, that fits within a pipe section 416 that comprises the bailout trigger. This short rod 412 is held in place by a pin 414 which is held in place with a small ball and spring mechanism (not shown) at its tip. At the opposite end of the pin, it is attached to a pull strap 415. When this loop is pulled, it will pull pin 414 and release the depower handle 418 and the trim-cable 422, 421 (bitter end) below, from the two center lines left side 411 and right side 410. This serves to immediately stop the pull of the kite on the kiter.

The pipe section 416 is connected to the trim-cable 422 and 421 (bitter end) and depower handle 418 with a non-releasing pin 417. The depower handle 418 contains a pulley 420 and jam cleat 419. The trim-cable 422 then leads down to where it is attached to an attachment point (not visible) on the kiter's harness. The bitter end of the trim-cable 421 is readily available to the kiter should they need to adjust the length of the trim-cable.

Referring now to FIGS. 5A and 5B. FIG. 5B shows a kite with the center lines 506 running down to where they are connected to a depower handle 507 in a vertical position (as indicated by the directional arrow adjacent to the depower handle) where it is connected at the bottom to a trim cable 508. This would be the default position where the kite is "powered up," and the depower handle may be grasped, but it is not being used to depower the kite any further than it has already been adjusted to by the tension of the trim-cable (not shown). When a kite is powered up, it means that the kite is near or at full power without additionally generating apparent wind through movement of the kite.

The half-circle gage in FIG. 5B indicates that the pull of the kite while in this position is somewhere above 50 percent. This measurement is very approximate, since numerous factors come in to play to cause the kite to increase or reduce its pull. The biggest factor causing a traction kite to increase its pull, is the apparent wind speed over the canopy, which is not depicted by the gages that correspond to FIG. 5A and FIG. 5B. Here, the gages primarily represent that a substantial decrease in pulling power is effected when the depower handle is manipulated as shown by the directional arrow under deployed depower handle 502 of FIG. 5A.

FIG. 5B illustrates the position in which the depower handle is not being grasped, as when the kite is being flown in a normal "noon" position. The noon position is where all traction kites are designed to be flown in their closest-to-neutral position. Wherein they create the least amount of pull on the kiter.

Referring again to FIG. 5B, it is apparent that the kite is not completely horizontal to the flow of the wind. What is depicted in this FIG. 5B is a traction kite flown in a normal "noon" or neutral position. Normal, because this would be the angle at which a kite on a legacy rigging apparatus without a depower handle 507 would be flown. FIG. 5A, on the other hand, illustrates an exemplar wherein the deployed depower handle 502 is grasped by the kiter, and it is pulled horizontally, as indicated by the directional arrow. By pulling the depower handle 507 horizontally, or by just putting additionally tension on the center lines 501, and thereby slacking the steering lines 504, with the other hand on the kite control bar 505 to maintain steering of the kite, the kiter is now able to create even more depower than what has already been created by a previous adjustment of the tension on the trim-cable 503.

Additionally, referring back to FIG. 3, this puts the kiter's hand in a position where they can readily manipulate the manual bailout trigger 302A and 302B as depicted in the exemplars as drawn in FIG. 3, should this become necessary.

As previously explained, the benefit of the kiter of being able to immediately release themselves from the pulling power of a powerful traction kite cannot be understated. This is a great improvement over the legacy kite rigging apparatuses. Additionally, being able to use the depower handle as described above in reference to FIG. 5, this will provide a kiter with much greater control over the pulling power of the kite. Especially while traversing unstable or slippery ground while the kiter is attempting to reach the water.

Referring now to FIG. 6A and FIG. 6B. FIG. 6A depicts an exemplar of a manual bailout trigger/depower handle. This exemplar shows a mechanism consisting of two separate portions, (1) an outer sleeve/handle upper part 603 with a lower portion 607, and (2), a flat strap comprising an upper part of the strap 602A, and a lower part of the strap 605A, that rides on a pivot pin 604 within a sleeve/handle (the hatched portion) that also comprises two parts, an upper part 603, and a lower handle portion 607. The center lines (not shown), and thus the leading edge of the kite is attached to a short piece of line 601 attached at the upper part 603 of the sleeve/handle. The outer sleeve/handle portion encloses the trigger in the upper part of the strap 602A and a jaws section in the lower part of the strap 605A. Wherein the trigger portion in the upper part of the strap 602A is vertical in FIG. 6A, directly above the jaws section in the lower part of the strap 605A.

This enablement keeps the trigger portion, upper part of the strap 602A folded inside the sleeve of the manual bailout trigger/depower handle since the upward pull of the kite, attached to the short piece of line 601, is in direct opposition of the kiter's pull on the bottom of the jaw section in the lower part of the strap 605A, which is below the pivot pin 604. The ring 608A that is sitting in the jaw section of the lower part of the strap 605A, is attached below to the trim-cable, pulley and jam cleat assembly, which is not shown. The lower part of the sleeve/handle portion 607 also covers the opening of the jaw, thereby preventing the ring, or pulley from sliding off the mechanism, unlike with the manual bailout trigger/depower handle depicted in FIG. 4A, FIG. 4B and FIG. 4C.

FIG. 6B depicts the manual bailout trigger/depower handle mechanism with the jaw section in the lower part of the strap 605B in the open position, after the trigger has been activated using the thumb or fingers of the kiter. The center lines (not shown) are attached to a short piece of line 601, and the trigger portion, the upper part of the strap 602B, has been pulled downwards away from the kite (not visible), wherein the trigger has pivoted on the pivot pin 604 within the sleeve/handle, and the jaw at the lower part of the strap 605B has released the ring 608B. By deploying this trigger, the kiter has effectively and immediately released themselves from the pull of the traction kite.

Referring now to FIG. 6C. FIG. 6C depicts a transparent right hand 613 holding the manual bailout trigger/depower handle assembly. As with the drawings for FIG. 6A and FIG. 6B, the center lines are attached at 601, and all of the force of the kite is pulling upwards at this point. The kiter is attached by their harness to the trim-cable (not shown) by the ring 608A, that is held firmly in the jaw section of the lower part of the strap 605A of the manual bailout trigger/depower handle mechanism, and the ring 608A cannot come out because the sleeve/handle (hatched portion) 607 is blocking it. Moreover, the downward force, as mentioned above, is keeping the ring 608A in its location. Should the manual bailout trigger need to be activated in this exemplar, the kiter could pull the trigger portion, the upper part of the strap 602A towards themselves, as indicated by the directional arrow 609.

Additionally, what the directional arrows 609 and 610 together depict is the direction that the kiter would twist the depower handle to depower the kite. Referring briefly back to FIG. 5A and FIG. 5B, one can see that by twisting the handle, and putting tension on the short piece of line 601, which is attached to the center line(s) at the top of the handle portion 607, the kiter will put some slack in the steering lines, which are attached to the distal ends of the bar, by changing the flying angle of the kite from that depicted in FIG. 5B to that depicted in FIG. 5A.

Moreover, performing a series of short tugs on the upper part of the depower handle right where it is attached to the center line(s) FIG. 6C, 601 in the direction of directional arrow 609 when attempting to launch or relaunch a kite in light wind may cause the kite to quickly climb into the air. As such, this exemplar depower handle also acts as a means of pumping the kite so that the wings and canopy of the kite flap to a certain degree to propel the kite skyward in very light wind conditions.

Currently, a technique of depowering a kite by grabbing and pulling on the center lines with one hand is a technique that is known to very, very few expert kiteboarders. It is not a methodology that is taught in kite schools, since the present manual bailout trigger/depower handle kite control apparatus does not exist in the art space. However, hopefully, with the introduction of the present apparatus, this will change, and all kiters that fly traction kites will not only make use of the manual bailout safety mechanism, but they will also learn to fly the kites with the ever-present understanding that they can readily depower their kites through use of the depower handle.

Moreover, because this manual bailout trigger/depower handle is mounted right in front of the kiter's eyes and within easy reach (FIG. 1A), its use may be intuitive, and thus it may become a popular safety mechanism that will be included in all traction kite rigging apparatuses.

Many lives and many injuries have occurred to date because too many kiters do not understand the dynamics of depowering their kites by changing the kite's angle of attack to the wind in the manner articulated here. This device may go a long way in solving this serious problem because by manipulating the handle, the kiter will immediately see and feel the change from a more vertical to a more horizontal aspect of the kite canopy, and thus understand the correlation between kite aspect and power.

Referring now to FIG. 7A, FIG. 7B, and FIG. 7C, FIG. 7A depicts a combination bailout trigger/depower handle that also contains a system for triggering a quick release that will be connected to the kiter's harness. An exemplar of a quick release that is attached to the harness is depicted in exemplar FIG. 2B, FIG. 2C1 and FIG. 2C2.

FIG. 7A depicts the depower handle 701A, and the at least one center line 702A that leads to the kite or kite bridle. FIG. 7A has a thumb activated bailout trigger 704A, which when pressed against a spring member 705A, releases the at least one center line 702A. This is accomplished when the orifice FIG. 7B, 706B and FIG. C, 706C is moved from the position shown in FIG. 7B, to the position shown in FIG. 7C. The blocking ball shown in all three figures, 707A, 707B and 707C that is affixed to the at least one center line 702A, 702B, and 702C, then slides through the orifice 706B and 706C, and thus immediately releasing the kiter from the pull of the kite, while also actuating the trigger line 708, which in turn activates the release, not shown in this embodiment, but illustrated by exemplar FIG. 2B, FIG. 2C1 and FIG. 2C2. The smaller ball 703A, 703B and 703C, serves merely to prevent the larger blocking ball 707A, and 707B and FIG. 7C, 707C from dropping away from its position at the slot near the orifice FIG. 7B, 706B and FIG. C, 706C.

Additionally, in FIG. 7A, the spring member 705A is pinned in place on the depower handle 701A with a fastener at 709. This exemplar also incorporates the pulley 711 and the jam cleat 713 into its structure. Here a kite tuning line 716 is depicted with 714 showing the bitter end where the kiter would grasp the line, and where the kite tuning line 716 would run through the kite control bar along with the trigger line 715, to where they are attached to the quick release attached to the kiter's harness as may be depicted in exemplar FIG. 2B, FIG. 2C1 and FIG. 2C2.

Note that although not depicted here, the pulley 711 mounted on pivot pin 712 of the exemplar apparatus may be replaced with a "low friction ring." A "low friction ring" is a fairly new innovation that has developed with the use of SPECTRA/DYNEEMA line in rigging, since SPECTRA/DYNEEMA line is considerably less friction resistant than the Dacron lines that were used in the years and decades prior to the adoption of SPECTRA/DYNEEMA lines in the maritime industry. Because SPECTRA/DYNEEMA line is more slippery than Dacron line, it will slide over an immovable surface, as with a low friction ring, and a pulley may not be needed.

Referring now to FIG. 8A, FIG. 8B and FIG. 8C. These three figures are variations of the embodiments shown in FIGS. 7A, 7B and 7C. The illustrated embodiments of FIGS. 8A, 8B, and 8C have all of the exact same elements and parts, except that here the bailout trigger FIG. 8A, 801A, FIG. 8B, 801B and FIG. 8C, 801C is actuated by the indicator finger of the kiter.

Referring now to FIG. 9A, FIG. 9B and FIG. 9C, which show three views of the semi-rigid member comprising a curved outer surface with the distal tips of the kite control bar extending towards the kite while the hole FIG. 9A, 903, and FIG. 9C 919 is central and proximal to the kiter from the distal tips of the kite control bar FIG. B, left side distal end 916 and right side distal end 917. All views illustrate that the rigid or semi-rigid member may be composed of a first curved outer surface, FIG. 9A, 902A and FIG. 9B, 902B, wherein the second interior surface FIG. 9A, 904 and FIG. 9C 921 forming a second curved inner surface that comprises a channel that deepens as it gets closer to the distal tips FIG. C, 918 and 921 of the kite control bar from where the central hole 919 is located.

FIG. 9C shows an example rigid or semi-rigid elongated member comprising a kite control bar without any rigging attached. This kite control bar may be manufactured from metal, fiberglass, carbon fiber, plastic or wood. The two steering strap-handles, shown in FIG. 9B, 907 and 908 are connectable to distal ends of the elongated member at 918 and 920, while the trim-cable would run through this exemplar and emerge through an orifice at 919. As depicted in all three views, FIG. 9A, FIG. 9B and FIG. 9C, the exemplar kite control bar may be composed of a semi-rigid member having a first shape comprising a rounded outer surface 902A outside of a second shape 904 defining a channel; and the second shape 904 defining an orifice through the first shape comprising a rounded outer surface 902A configured to receive a trim-cable portion 901 of the rigging of the kite. In some embodiments, two steering strap-handles which are affixed at distal ends of the elongated member. These, in turn are attached to two steering lines (not shown) that would lead to the two distal ends of a kite (not shown).

This kite control bar by virtue of its bowed shape naturally allows for the kite to fly at the noon- or neutral position since the connections to the steering lines at the distal ends FIG. 9B, left side distal end 916 and right side distal end 917, FIG. 9C left side distal end 918 and right side distal end 920 are slightly closer to the kite than where the trim-cable emerges (e.g., at central hole 919) from a centrally located sleeve.

Additionally, shown here in FIG. 9B, the recovery strap 915 extends from where it is releasably connected to a quick release (not shown), along with the trim-cable 914, to a user-worn harness on the kiter (not shown) and running upwards along a channel 913 formed by shape two, FIG. 9A, 904, to where it comes out the right side distal end FIG. 9B, right side distal end 917 and extends upwards 912 to where it would connect to an attachment point on one of the at least one steering lines (not shown). Although the steering lines are not shown, the (patterned) left side steering strap-handle 907 and the right side steering strap-handle 908 are shown attached to the distal ends of the kite control bar, In exemplars FIG. 9A and FIG. 9B, a reinforced area is shown by the patterned area at 905 and 910 on both sides of where the trim-cable 901 to 906 and 911 to 914 slides through a hole or sleeve 903 in the kite control bar to where it would extend to where the jam cleat and pulley system is attached (not shown). Additionally, the area as depicted by the patterned area 910 in this exemplar, may be a sealed hollow area, or it may contain a buoyant material so that the kite control bar will float if the kiter should need to release it.

In FIG. 9A, the cross-section view of the bar, the patterned surface 905 corresponds with the end of the reinforced area FIG. 9B, 910. An outer curved surface FIG. 9A, 902A corresponds with an outer curved surface in FIG. 9B, 902B. The channel or second shape, which is a generally curved inner surface is shown in FIG. 9A 904, and the hole or sleeve 903 is indicated where the trim-cable runs from where it would be attached to the kiter 906 through the kite control bar to 901 where it would connect to a jam cleat and pulley system (not shown), or a jam cleat and low-friction ring (not shown).

Finally, FIG. 9B shows a clear representation of the steering strap-handles; left side steering strap-handle 907 and right side steering strap-handle 908 of indeterminate length. Ideally, they should be between 12 to 18 inches in length. As previously stated, these steering strap-handles provide a positive grip that allows the kiter to control the pivot speed of the kite with controlled tugs or pulls on these steering strap-handles. The ability to pivot the kite before it hits the water (e.g., during high-speed maneuvers as described further below in reference to FIG. 17), is greatly facilitated by use of steering strap-handles. See also FIG. 16 and FIG. 17 in reference to high-speed maneuvers facilitated by using the steering strap-handles.

Further details regarding general approaches to the use of steering strap-handles for performing the high-speed maneuvers described as "dynamic loops" or "power loops" are provided in U.S. application Ser. No. 17/246,658, titled Biomechanically Adapted Sportsboard, filed May 2, 2021, which is hereby incorporated by reference in its entirety.

Referring now to back to FIG. 9D. FIG. 9D illustrates an exemplar of a kite control bar, with none of the additional rigging attached, except for the steering strap-handles: left side handle 924 and right side handle 927. Additionally, these steering strap-handles are independently adjustable through the use of integrated buckles or an inline jam-cleat portion 922 and 925 and allow for individual length adjustment. This is a sometimes desirable mechanism to allow the kiter to adjust the steering lines individually, should they stretch. An adjustment is accomplished by pulling on the respective bitter ends of the steering strap-handles, or lines/ropes, should that be the case. Here, the kite control bar is shown with the option of having various gages 930, digital graphs 928 or digital readout screens 932 mounted on it. A sealed or sealable containment space within the left side wall 929 and the right side wall 931 as depicted by broken lines may contain electronics or batteries, as needed. This containment area will be readily accessible from the bottom of the kite control bar (not shown) since it will fit in channel 933, contained within the bar. Many different possibilities come to mind.

Because kite-foiling racing is a popular competitive sport, and may become an Olympic sport, these possibilities may include a gage 930 reflecting the apparent wind speed as read by a sensor mounted on the leading edge of the kite (not shown); or they may include a speed gage. Other options for these various gages 930, digital graphs 928 or digital readout screens 932 are an altimeter to measure the height of a kiter's jumps, or even a heart-rate monitor. Additionally, the channeled 933 design of the kite control bar as shown may house batteries, or perhaps a sound system, or a communications system which would be connectable to earbuds worn by the kiter. Other electronics yet not envisioned may also be incorporated in this flat-surfaced kite control bar. Flat surfaces, where the various instruments would be mounted.

Referring now to FIG. 10. FIG. 10 depicts an exemplar of a kite control bar with a channeled distal tip 1013 that may be composed of a tubular kite control bar also with a small optional open channel running along its bottom length (not shown). The recovery strap or line is depicted running from where it is connected to a ring 1020, or other fixture that is releasably connected to a user-worn harness, belt, clamp, article of clothing or otherwise, worn by the kiter (not shown). The recovery strap or line 1016 then runs up to where it is releasably held in place by a Velcro strap, or other releasable fixture 1012, where it runs within the optional channel within the bar (not shown), and through another releasable fixture 1018 up through the channeled distal tip, as depicted by a broken line which is then depicted as a solid line representing the recovery strap or line 1006 where it emerges from the channeled distal tip 1013 to where it runs parallel to the steering strap-handle 1010 to where it is ultimately attached (not shown) to the right hand steering line 1105. This recovery strap/line may also be located on the left side of the bar parallel to the left-hand steering strap 1008 where it would ultimately be attached to the left side steering line 1001, in the same manner as depicted here.

The center lines 1021 are shown running through an elliptically shaped float 1002 depicted by broken lines. The float 1002 is integral with pin 1022 shown held in place by a release pin 1004, that would be attached to a pull strap 415 as shown in FIG. 4D (not shown in this figure). Once the release pin 1004 is removed, the jam-cleat and pulley assembly 1007 together with the trim-cable 1011, 1009, 1015 will be separated from center lines 1021 and thus the leading edge of the kite (not shown) will also be unattached to the control apparatus at this point. Meanwhile, the kite control bar 1014 will remain attached to the user-worn harness, belt, clamp, article of clothing or otherwise, worn by the kiter, unless the kiter should choose to release the rest of the apparatus with another quick release (not shown). Should the kiter trigger the manual quick release at their waist, the kite would then be flagged out completely on the right side steering line, because it would still be attached to the recovery strap or line 1006, 1017, and 1016 which would be attached to a ring 1020, that is releasably attached to another manual quick release which is attached to the user-worn harness, belt, clamp, article of clothing or otherwise, worn by the kiter Should the kiter want to jettison the entire rigging apparatus and the kite, the kiter would release the ring 1120 from where it would be releasably attached from the user-worn harness, belt, clamp, article of clothing or otherwise, worn by the kiter.

Additionally, the exemplars in FIGS. 10 and 11 depict curved kite control bars. This is a significant design departure from the legacy straight kite control bars, with protruding ends, that have a tendency to cause a steering line to get accidentally get trapped under a kite control bar end, or under the kite control bar itself, and thus get "wrapped" on the bar. This wrapping of a steering line around the kite control bar is a not infrequent occurrence that often results in the aforementioned dangerous phenomena wherein the kite begins death-looping and dragging the kiter.

Using a kite control bar that is curved in the bow-shape, as depicted in these exemplars without any protrusions along the lower edge may substantially cure this unfortunate and dangerous design defect inherent in the legacy kite control bars. Additionally, the bars depicted in FIG. 9 through FIG. 13 series also have no protrusions at the underside of the distal ends, which is the standard with the legacy kite control bars.

Referring now to FIG. 11. FIG. 11 depicts a minimalist embodiment of a version of the present apparatus with the manual bailout trigger assembly 1102 which is identical to the exemplar illustrated by FIG. 10, except that the recovery strap is eliminated. Here, once the manual bailout trigger assembly 1102 is activated, and separated from the trim cable 1104, and the kite is now solely held by the steering lines, which are attached to extra-long steering strap-handles 1101 and 1103, the kiter may release the entire apparatus, including the kite control bar 1108, by releasing the ring 1107 from their user-worn harness, belt, clamp, article of clothing or otherwise, worn by the kiter, while at the same time holding onto one of the extra-long steering strap-handles. So long as the kiter has hold of the steering strap close enough to the kite and away from the distal end of the kite control bar, this may cause the kite to then flag out on the steering line and steering strap-handle that the kiter still has ahold of.

Referring now to FIG. 12A and FIG. 12B. FIG. 12A and FIG. 12B utilize the conventional tubular kite control bar and omit any recovery strap.

Referring to FIG. 12A. Once the manual bailout trigger 1501 is activated and the kite is solely restrained by the left steering line/steering strap-handle 1202 and the right steering line/steering strap-handle 1203, the recovery and control of a downed kite would be similar to what is described above in the detailed description under FIG. 11. With FIG. 12A, the kiter would need to release the apparatus by releasing the ring 1207 from the user-worn harness, belt, clamp, article of clothing or otherwise, worn by the kiter, while retaining hold of one of the steering strap-handles 1202 or 1203. Even without a recovery strap, activating the manual bailout trigger 1201 would immediately break the pull of the kite (not shown) since the manual bailout trigger 1201 would be separated from the trim-cable 1204 and 1206, along with the ring 1207, and the kite control bar 1205.

Referring now to FIG. 12B. FIG. 12 B shows an exemplar with a conventional tubular bar, but it has a rigid sliding ring 1212 that encircles the kite control bar 1213. It also has a left steering strap-handle 1209, and a right steering strap-handle 1210. Once the manual bailout trigger 1208 is activated, and the lower ring 1217 with the attached trim-cable 1215 is also released from where it is attached to the user-worn harness, belt, clamp, article of clothing or otherwise, worn by the kiter, the entire apparatus may still be releasably attached by short recovery strap 1214 that is attached to the ring 1216 that is also releasably attached to the user-worn harness, belt, clamp, article of clothing or otherwise, worn by the kiter. At this point the unequal tension on the two steering lines may cause the rigid sliding ring 1212 to slide along the kite control bar 1213, over the tip of the bar, and along the steering strap-handle 1210. This will then cause the kite to flag-out on one of the steering strap-handles 1210 and attached steering lines as desired. And thus, there may no longer be the danger of a relaunch and thus no danger of the kite going into a death-loop and dragging the kiter with it.

Referring now to FIG. 13A. FIG. 13A illustrates one exemplar of a kite rigging control apparatus wherein the manual bailout trigger 1301 is activated by electronic means by a button 1306 that is mounted on an elongated kite control bar 1305. This thumb or finger button may be mounted to the bar, or attached to a ring that is later clamped to an existing kite control bar. Further, although not illustrated here, a mechanism that electronically triggers the manual bailout trigger could be attached anywhere where it is accessible to the kiter. Even a mechanism that is held in the mouth or a part of a glove, is contemplated. The left steering strap-handle 1302 and the right steering strap-handle 1303, are shown here, along with the trim-cable 1304 that terminates at a ring 1307 that is releasably attached to the user-worn harness of a kiter.

Referring now to FIG. 13B. FIG. 13B illustrates another exemplar of a kite control bar 1312 with a manual bailout trigger 1308, with a left-hand steering strap-handle 1309, and a right-hand steering strap-handle 1311, and a trim-cable 1310 that is releasably attached to the user-worn harness of the kiter by a ring 1314. What is unique in this exemplar is that the recovery strap is attached to a short handle or knob 1313 that is releasably attached to the kite control bar 1312, such that the kiter may grasp this short handle or knob with their first 1316 as indicated, to maintain control of the kite once the entire rigging apparatus has been detached from the kiter at the ring 1314.

Referring now to FIG. 14. FIG. 14 illustrates a control apparatus for a bailout trigger 1402 suspended between passenger(s) 1403 and a parasail, the bailout trigger 1402 is configured to be remotely activated from a boat 1401. Other means not illustrated in this exemplar may be that: the trigger may have the effect of separating the passenger from the parasail; or the trigger may open vents in the parasail that cause it to gradually reduce its lift and transcend downwards into the water. Other means of activation may be to have the trigger activated by the passenger. Another means, not illustrated here, may be of having the bailout trigger activated by having someone onboard the boat tug on a line that runs alongside the main tow-rope (not shown here). Another means, not shown, of activating the bailout trigger may be through remotely activating it by wireless means.

By including a bailout trigger, as described above to every parasail rigging apparatus, this may help prevent death or injury to a parasail passenger should a parasail boat operator feel his vessel is in danger because the parasail is dragging the boat. As was recently reported in the press, this situation occurred where a parasail boat operator had three passengers in tow, and he felt the need to "cut them loose." Sadly, this ultimately resulted in the death of all three passengers. The application of a bailout trigger apparatus, as described may have prevented this.

Now, referring back to the kite rigging control apparatus in FIG. 1B and FIG. 2A, and more specifically, the application of the aforementioned steering strap-handles. In the legacy rigging apparatus FIG. 1B, the kiter is expected to steer the kite solely with both hands on the kite control bar 113. Thus, there is no provision for fine control of the kite as it is flying, since although there is padding 115 and 116 attached to and encircling the steering line, left hand steering line 102A and right hand steering line, 103A, this padding is designed solely to protect a kiter's fingers from line-cuts and to provide buoyancy should the handle be released on the water.

In significant contrast, as shown in the exemplar illustrated in FIG. 2A, the present design incorporates steering strap-handles 216 and 217 as an attached lower portion of the steering lines 202 and 203. These steering strap-handles 216 and 217 are designed to be grasped by the kiter, and they thus allow for a much finer and nuanced control of the kite in that they provide a means of controlling the pivot speed of the kite 212. This is because manipulation of the steering strap-handles can be done more subtly and precisely than through a sole use of the kite control bar 213 itself, and these steering strap-handles 216 and 217 allow for a differentiated pull on the kite's steering points independent of a reciprocal movement of the opposite ends of the kite control bar 213.

Controlling the pivot speed of a kite allows a kiter to reduce the speed of apparent wind over the canopy of the kite, and thus dynamically change the power and the pull of the kite momentarily. This is a highly desirable trait when performing a high-speed "down-loop transition." This is a powerful and dynamic way to perform a transition that the Inventor of the present kite control apparatus has innovated, developed and perfected over the last decade. A down loop transition is where the powerful traction kite is flown from high and looped down and into the opposite direction. This is in contrast to the traditional transitions wherein a kite is flown upwards, and then in the opposite direction. This dynamic transition methodology is performed best through use of the—steering strap-handles, handles FIG. 2A, 216 and 217, wherein a kiter can directly modify the pull of a traction kite in a way that is not possible by simply gripping the kite control bar.

Referring now to FIG. 15. FIG. 15 depicts an exemplar of a kiter on a traditional twin-tip kiteboard performing a traditional transition wherein the kite is flown upwards and over the "power zone," against the pull of gravity, while the kiteboarder performs a wide turn, or reverses the direction of their board to commence sailing in the opposite direction. During this maneuver, since the kite is flown upwards, it is naturally slowed by gravity, which in turn decreases the speed of the air traveling over the canopy, and thus substantially reduces the pull of the kite. This is illustrated in FIG. 15 showing a traction kite flown in the traditional style, in a broad upwards arc, which also illustrates the wide slow corresponding arc of the board, should it be carved through the traditional turn, as also depicted in FIG. 15.

Contrast this with what is shown in FIG. 16, which depicts a kite that is flown in a "power loop" or a "down loop." As used herein, these terms describe a maneuver as follows: The arc of the kite is much tighter in FIG. 16 when performing a power loop, as compared to FIG. 15. The kite accelerates rapidly when it is directed downwards and subject to the pull of gravity, and the pull of the kite also surges as the speed of the air or wind correspondingly accelerates over the kite canopy. Under these conditions it is helpful to use the steering strap-handles (See also FIGS. 2A, 2B, 9B, 9D, 10, 11, 12A, 12B, 13A, and 13B) to pivot the kite before it hits the water. This maneuver then launches the kite downwind and through the "power zone," which also attenuates the increased acceleration and corresponding power-surge created by the kite. Because of this rapid redirection and acceleration of the traction kite, the kiter must also carve the board in a tighter arc on the water.

The effect is that this creates a very exhilarating maneuver that is similar in feel to performing a bottom turn at the bottom of a large wave or a cutback on the shoulder of the wave on a regular surfboard. Thus, it is both a desirable and aspirational maneuver for many kiters, and especially surfers who are transitioning to kiteboarding.

ADDITIONAL EMBODIMENTS

In some embodiments, a control apparatus for a traction kite includes a rigid or semi-rigid elongated member having first and second attachment points to at least two steering lines and a third attachment point to a trim-cable assembly. This embodiment may further include a manual bailout trigger configured to attach at least one center line of the traction kite to the trim-cable assembly.

The foregoing embodiment could be further configured such that the depower handle contains a recovery line that connects the released depower handle and manual bailout trigger assembly to the trim-cable.

The foregoing embodiment could be further configured such that the apparatus includes a swivel connectable to a user-worn harness, belt, clamp, article of clothing or otherwise, worn by the kiter.

The foregoing embodiment could be further configured such that at least a portion of the trim-cable assembly includes a quick release shackle.

The foregoing embodiment could be further configured such that the apparatus includes a bundle or coil of the at least one of the at least two steering lines, and further includes a bundle or coil of the at least one of the at least two center lines.

The foregoing embodiment could be further configured such that the apparatus includes a bundle or coil of at least one recovery line.

The foregoing embodiment could be further configured such that the apparatus includes traction kite components, wherein at least two steering lines are affixed to at least one of, at least one of the distal ends of the traction kite components, or the rigid or semi-rigid elongated member.

The foregoing embodiment could be further configured such that the apparatus includes at least two steering lines which are affixed at distal ends of the elongated member to distal ends of the kite, or to other locations on the kite where steering lines would be affixed.

The foregoing embodiment could be further configured such that the apparatus includes a recovery strap which is releasably attached to a user-worn harness, belt, clamp, article of clothing or otherwise, worn by the kiter.

The foregoing embodiment could be further configured such that the apparatus includes a trim-cable which is removably attached to a swivel that is proximal to the kiter and the trim-cable is attached to at least one center line at its distal end, wherein the center line is attached directly or indirectly to the leading edge of the kite, proximally to the where the at least two steering lines are attached.

The foregoing embodiment could be further configured such that the apparatus includes a trim-cable that is removably attached to the swivel that is connected between the kiter and the elongated member that is proximal to the kiter, and the trim-cable is attached to at least one center line at its distal end which includes a pulley and jam-cleat assembly.

The foregoing embodiment could be further configured such that the apparatus includes at least one center line which is removably attached via a manual bailout trigger assembly from the jam-cleat and pulley assembly where it includes a portion of the trim-cable at the distal end of the trim-cable.

The foregoing embodiment could be further configured such that the recovery strap is removably attached from a quick-release shackle attached to the swivel that is attached to the user-worn harness, belt, clamp, article of clothing or otherwise, worn by the kiter.

The foregoing embodiment could be further configured such that the apparatus includes a recovery strap that is releasably attached to clips on several sliding sleeves or loops that encircle the proximal portion of the trim-cable.

The foregoing embodiment could be further configured such that the recovery strap is run through an elastic tubular member and is connectable by a second quick release that is attached to a user-worn harness, belt, clamp, article of clothing, or otherwise, worn by the kiter.

The foregoing embodiment could be further configured such that the apparatus includes a swivel that is removably attached with a quick release shackle from a user-worn harness, belt, clamp, article of clothing or otherwise, worn by the kiter.

The foregoing embodiment could be further configured such that the recovery strap is connectable to a quick release after running through a spring-loaded reel.

The foregoing embodiment could be further configured wherein the proximal end of the recovery strap is attached to a separable handle mounted on the second shape of the semi-rigid member.

The foregoing embodiment could be further configured such that includes a depower handle that contains a recovery line having the means for reconnecting the released depower handle and manual bailout trigger assembly to the distal end of the trim-cable.

The foregoing embodiment could be further configured such the apparatus includes a pulley and jam cleat assembly that makes up the contents of a depower handle portion attached to the trim-cable or wherein a depower handle attached to the trim-cable is located immediately proximal to the kiter but above where the pulley and jam-cleat assembly is located.

The foregoing embodiment could be further configured such that the apparatus includes a recovery strap that is removably attached from a quick-release shackle attached to a swivel.

The foregoing embodiment could be further configured to comprise a control apparatus for a manual bailout trigger (FIG. 14, 1402) suspended between passengers and a parasail with a means for detaching the passengers (FIG. 14, 1403) from the parasail.

The foregoing embodiment could be further configured such that the bailout trigger is manually activated from the towing vessel by a line that runs alongside a main tow-rope (FIG. 14).

The foregoing embodiment could be further configured such that the bailout trigger is remotely activated by an electronic device (FIG. 14, 1401).

The foregoing embodiment could be further configured such that the bailout trigger is configured to release a portion of the parasail such that the lift of the parasail decreases gradually (FIG. 14).

What is claimed is:

1. A control apparatus for a traction kite, the control apparatus comprising:

an elongated member having a first distally located attachment point, and a second distally located attachment point, the first distally located attachment point and the second distally located attachment point being connectable to at least two steering lines;

a hand-actuated bailout trigger, attached between the traction kite and the elongated member, the hand-actuated bailout trigger configured to release at least one center line of the traction kite;

and, a recovery strap that is detachable from a user-worn harness and is attached to at least one of the at least two steering lines.

2. The control apparatus of claim 1, wherein a hand-actuated handheld bailout trigger between the traction kite and the elongated member further comprises a depower handle.

3. The control apparatus of claim 1, wherein a hand actuated bailout trigger/depower handle, also comprises a pulley and/or block and jam-cleat portion.

4. The control apparatus of claim 1, wherein an automatic release mechanism is connectably attached between a trim-cable assembly and a kite harness, which may also be manually and independently activated, wherein the automatic release mechanism is automatically activated through a connection to the hand-actuated bailout trigger.

5. The control apparatus of claim 1, wherein a recovery strap is connectable between a kiter's harness and one steering line.

6. The control apparatus of claim 1, wherein the at least two steering lines are attached to two steering strap-handles which are connectable to the first distally located attachment point and the second distally located attachment point of the elongated member.

7. The control apparatus of claim 6, wherein the two steering strap-handles which are connectable to the first distally located attachment point and the second distally located attachment point of the elongated member also integrate buckles or an inline jam-cleat portion which allow for individual length adjustment of each of the two steering strap-handles.

8. The control apparatus of claim 1, wherein an elongated member comprising a kite control bar is curved, so that the elongated member is shaped in a manner that prevents the steering lines from catching on either of the first distally located attachment point or the second distally located attachment point of the elongated member comprising a kite control bar.

9. The control apparatus of claim 1, wherein at least a portion of the elongated member comprises a channel having a curved outer surface or a curved inner surface.

10. A method for manufacture of a traction kite control apparatus, the method comprising:

providing an elongated member having first and second distally located attachment points, the first and second distally located attachment points connectable to at least two steering lines;

providing a hand-actuated bailout trigger attached between a traction kite and the elongated member and, providing a recovery strap that is detachable from a user-worn harness and is attached to at least one of the at least two steering lines.

11. The method of claim 10, wherein the hand-actuated bailout trigger comprises metal, fiberglass, carbon fiber, or plastic.

12. The method of claim 10, wherein the elongated member comprises metal, fiberglass, carbon fiber, plastic or wood.

13. A control apparatus for a traction kite, the control apparatus comprising:

an elongated member having first and second distally located attachment points, the first and second distally located attachment points having a means for being connectable to at least two steering lines; and a hand-actuated bailout trigger attached between the traction kite and the elongated member and, providing a recovery strap that is detachable from a user-worn harness and is attached to at least one of the at least two steering lines.

14. The control apparatus of claim 13, further comprising a means for swiveling the control apparatus separately from where it is attached to a harness, belt, clamp, article of clothing or otherwise, worn by a kiter.

15. The control apparatus of claim 13, wherein a recovery strap is connectable to at least one steering line which is connectable to the traction kite at a distal end of the traction kite, the recovery strap having a means for releasably attaching to a quick-release shackle attached to a user-worn harness.

16. The control apparatus of claim 13, wherein a recovery strap is attached to a slider-ring that encircles the elongated member with a means for sliding along the elongated member, over a distal end of the elongated member and onto a steering strap-handle.

* * * * *